US009352198B2

(12) United States Patent
Roach et al.

(10) Patent No.: US 9,352,198 B2
(45) Date of Patent: May 31, 2016

(54) MULTI-MATERIAL GOLF CLUB HEAD

(71) Applicant: Cobra Golf Incorporated, Carlsbad, CA (US)

(72) Inventors: Ryan L. Roach, Carlsbad, CA (US); Andrew Curtis, Solana Beach, CA (US)

(73) Assignee: COBRA GOLF INCORPORATED, Carlsbad, CA (US)

( * ) Notice: Subject to any disclaimer, the term of this patent is extended or adjusted under 35 U.S.C. 154(b) by 226 days.

(21) Appl. No.: 13/922,754

(22) Filed: Jun. 20, 2013

(65) Prior Publication Data

US 2013/0281227 A1 Oct. 24, 2013

Related U.S. Application Data

(63) Continuation-in-part of application No. 13/022,577, filed on Feb. 7, 2011, now Pat. No. 8,491,412, which is a continuation of application No. 11/822,197, filed on Jul. 3, 2007, now Pat. No. 7,922,604.

(60) Provisional application No. 60/832,228, filed on Jul. 21, 2006.

(51) Int. Cl.
*A63B 53/04* (2015.01)
*A63B 59/00* (2015.01)

(52) U.S. Cl.
CPC ..... *A63B 53/0475* (2013.01); *A63B 53/047* (2013.01); *A63B 59/0092* (2013.01); *A63B 60/54* (2015.10); *A63B 2053/0416* (2013.01); *A63B 2053/0425* (2013.01); *A63B 2053/0433* (2013.01); *A63B 2053/0454* (2013.01); *A63B 2053/0491* (2013.01); *A63B 2209/00* (2013.01)

(58) Field of Classification Search
USPC ..... 473/324–350
See application file for complete search history.

(56) References Cited

U.S. PATENT DOCUMENTS

| | | | |
|---|---|---|---|
| 819,900 | A | 5/1906 | Martin |
| 1,319,233 | A | 10/1919 | Mattern |
| 1,534,600 | A | 4/1925 | Mattern |
| 2,429,351 | A | 10/1947 | Fetterolf |
| 2,686,056 | A | 8/1954 | Oquist |
| 3,084,940 | A | 4/1963 | Cissel |
| 3,695,618 | A | 10/1972 | Woolley et al. |
| 3,881,733 | A | 5/1975 | Csernits |
| 3,970,236 | A | 7/1976 | Rogers |
| 3,975,023 | A | 8/1976 | Inamori |
| 4,027,885 | A | 6/1977 | Rogers |
| 4,340,230 | A | 7/1982 | Churchward |
| 4,398,965 | A | 8/1983 | Campau |
| 4,523,759 | A | 6/1985 | Igarashi |

(Continued)

*Primary Examiner* — John E Simms, Jr.
(74) *Attorney, Agent, or Firm* — Brown Rudnick LLP; Mark S. Leonardo

(57) ABSTRACT

The invention provides a golf club head that uses a light-weight material for part of the body and a strong material for a face-to-sole transition to provide a durable face with a high coefficient of restitution. The club head may have a first body part and a second body part. Material of the first body part extends down from a face member, bends around a face-sole transition, and continues into a sole return member to provide at least a portion of a ball-striking face and a sole surface. The first body part also provides a hosel. The second body part provides a significant proportion of the volume of the club head (e.g., at least about a third or even a majority). The low-density of the second body part allows for inclusion of one or more high-density third body parts to optimize mass distribution.

12 Claims, 20 Drawing Sheets

(56) References Cited

U.S. PATENT DOCUMENTS 4,607,846 A 8/1986 Perkins
4,681,322 A 7/1987 Straza et al.
4,687,205 A 8/1987 Tominaga et al.
4,792,139 A 12/1988 Nagasaki et al.
4,811,950 A 3/1989 Kobayashi
4,874,171 A 10/1989 Ezaki et al.
4,884,812 A 12/1989 Nagasaki et al.
4,928,972 A 5/1990 Nakanishi et al.
4,957,294 A 9/1990 Long
4,964,640 A 10/1990 Nakanishi et al.
D321,920 S 11/1991 Parente et al.
5,104,457 A 4/1992 Viljoen et al.
5,106,094 A 4/1992 Desbiolles et al.
5,190,290 A 3/1993 Take
5,221,087 A 6/1993 Fenton et al.
D339,183 S 9/1993 Stites, III
5,242,167 A 9/1993 Antonious
D343,216 S 1/1994 Chorne
5,290,036 A 3/1994 Fenton et al.
5,299,807 A 4/1994 Hutin
5,303,922 A 4/1994 Lo
5,316,298 A 5/1994 Hutin et al.
5,377,979 A 1/1995 Long
5,377,985 A 1/1995 Ohnishi
5,398,929 A 3/1995 Kitaichi
5,403,007 A 4/1995 Chen
5,405,137 A 4/1995 Vincent et al.
5,409,229 A 4/1995 Schmidt et al.
5,413,336 A 5/1995 Iwanaga
5,431,396 A 7/1995 Shieh
5,433,440 A 7/1995 Lin
5,492,327 A 2/1996 Biafore
5,518,243 A * 5/1996 Redman ..... 473/334
5,544,885 A 8/1996 Besnard et al.
5,564,705 A 10/1996 Kobayashi et al.
5,586,947 A 12/1996 Hutin
5,586,948 A 12/1996 Mick
5,588,923 A 12/1996 Schmidt et al.
5,605,511 A 2/1997 Schmidt et al.
5,616,088 A 4/1997 Aizawa et al.
5,626,530 A 5/1997 Schmidt et al.
5,643,112 A 7/1997 Besnard et al.
5,669,826 A 9/1997 Chang et al.
5,669,829 A 9/1997 Lin
5,683,310 A 11/1997 Chen
5,692,972 A * 12/1997 Langslet ..... 473/332
5,697,855 A 12/1997 Aizawa
5,704,849 A 1/1998 Schmidt et al.
5,713,800 A 2/1998 Su
5,720,673 A 2/1998 Anderson
5,766,092 A 6/1998 Mimeur et al.
5,772,527 A 6/1998 Liu
5,776,010 A 7/1998 Helmstetter et al.
5,833,551 A 11/1998 Vincent et al.
5,863,261 A 1/1999 Eggiman
5,890,973 A 4/1999 Gamble
5,924,939 A 7/1999 Grace et al.
5,944,619 A 8/1999 Cameron
5,967,903 A 10/1999 Cheng
5,993,329 A 11/1999 Shieh
6,001,030 A 12/1999 Delaney
6,042,486 A 3/2000 Gallagher
6,045,456 A 4/2000 Best et al.
6,080,069 A 6/2000 Long
6,089,992 A 7/2000 Onuki et al.
6,095,931 A 8/2000 Hettinger et al.
RE36,950 E 11/2000 Allen
6,183,376 B1 2/2001 Peters et al.
6,217,460 B1 4/2001 Broadbridge et al.
6,231,458 B1 5/2001 Cameron et al.
6,267,691 B1 7/2001 Dammen
6,306,048 B1 10/2001 McCabe et al.
6,319,149 B1 11/2001 Lee
6,319,150 B1 11/2001 Werner et al.
6,334,818 B1 1/2002 Cameron et al.
6,338,683 B1 1/2002 Kosmatka
6,354,962 B1 3/2002 Galloway et al.
6,358,158 B2 3/2002 Peters et al.
6,364,789 B1 4/2002 Kosmatka
6,379,262 B1 4/2002 Boone
6,381,828 B1 5/2002 Boyce et al.
6,390,933 B1 5/2002 Galloway et al.
6,398,666 B1 6/2002 Evans et al.
6,428,426 B1 8/2002 Helmstetter et al.
6,428,427 B1 8/2002 Kosmatka
6,440,010 B1 8/2002 Deshmukh
6,443,857 B1 9/2002 Chuang
6,471,604 B2 10/2002 Hocknell et al.
6,478,690 B2 11/2002 Helmstetter et al.
6,491,592 B2 12/2002 Cackett et al.
6,491,593 B2 12/2002 Takeda
6,524,196 B1 2/2003 Yeh
6,554,722 B2 4/2003 Erickson et al.
6,558,272 B2 5/2003 Helmstetter et al.
6,565,452 B2 5/2003 Helmstetter et al.
6,569,033 B2 5/2003 Kosmatka
6,582,321 B2 6/2003 Galloway et al.
6,582,323 B2 6/2003 Soracco et al.
6,592,468 B2 7/2003 Vincent et al.
6,592,469 B2 7/2003 Gilbert
6,602,150 B1 8/2003 Kosmatka
6,605,007 B1 8/2003 Bissonnette et al.
6,616,547 B2 9/2003 Vincent et al.
6,623,377 B2 9/2003 Evans et al.
6,638,183 B2 10/2003 Takeda
6,659,885 B1 12/2003 Knuth
6,663,504 B2 12/2003 Hocknell et al.
6,688,989 B2 2/2004 Best
6,709,345 B2 3/2004 Iwata et al.
6,719,641 B2 4/2004 Dabbs et al.
6,739,983 B2 5/2004 Helmstetter et al.
6,743,114 B2 6/2004 Best
6,743,117 B2 6/2004 Gilbert
6,769,998 B2 8/2004 Clausen et al.
6,773,361 B1 8/2004 Lee
6,811,496 B2 11/2004 Wahl et al.
6,824,475 B2 11/2004 Burnett et al.
6,835,144 B2 12/2004 Best
6,849,005 B2 2/2005 Rife
6,855,066 B2 2/2005 Best
6,857,973 B2 2/2005 Wieland et al.
6,860,820 B2 * 3/2005 Specht ..... 473/312
6,860,822 B2 3/2005 Vrska, Jr.
6,863,626 B2 3/2005 Evans et al.
6,872,153 B2 3/2005 Gilbert et al.
6,875,124 B2 4/2005 Gilbert et al.
6,887,164 B2 5/2005 Dewanjee et al.
6,899,638 B2 5/2005 Iwata et al.
6,902,495 B2 6/2005 Pergande et al.
6,902,945 B2 6/2005 Mann et al.
6,918,840 B2 7/2005 Stites et al.
6,921,344 B2 7/2005 Gilbert et al.
6,991,559 B2 1/2006 Yabu
6,997,820 B2 2/2006 Willett et al.
7,008,331 B2 3/2006 Chen
7,018,305 B2 3/2006 Sugimoto
7,029,403 B2 4/2006 Rice et al.
7,048,647 B2 * 5/2006 Burrows ..... 473/334
7,070,513 B2 7/2006 Takeda et al.
7,144,337 B2 12/2006 Hirano
7,160,204 B2 1/2007 Huang
7,182,698 B2 2/2007 Tseng
7,186,188 B2 3/2007 Gilbert et al.
7,192,362 B2 3/2007 Gilbert et al.
7,238,119 B2 7/2007 Roach et al.
7,244,188 B2 * 7/2007 Best ..... 473/291
7,384,348 B2 6/2008 Lin et al.
7,387,579 B2 6/2008 Lin et al.
7,476,162 B2 1/2009 Stites et al.
7,597,633 B2 10/2009 Shimazaki et al.
7,654,914 B2 2/2010 Roach et al.
7,662,050 B2 2/2010 Gilbert et al.
7,713,141 B2 5/2010 Yamamoto
7,871,338 B2 1/2011 Nakano

(56) References Cited

U.S. PATENT DOCUMENTS

| | | | | |
|---|---|---|---|---|
| 7,914,395 | B2 | 3/2011 | Stites et al. | |
| 7,922,604 | B2 * | 4/2011 | Roach et al. | 473/350 |
| 7,980,960 | B2 * | 7/2011 | Gilbert et al. | 473/290 |
| 7,997,999 | B2 * | 8/2011 | Roach | A63B 53/047 473/332 |
| 8,133,129 | B2 * | 3/2012 | Boyd et al. | 473/288 |
| 8,206,241 | B2 * | 6/2012 | Boyd et al. | 473/332 |
| 8,388,464 | B2 * | 3/2013 | Gilbert et al. | 473/332 |
| 8,491,412 | B2 | 7/2013 | Roach et al. | |
| 8,870,682 | B2 * | 10/2014 | Roach | 473/349 |
| 8,979,674 | B2 * | 3/2015 | Oldknow | A63B 53/047 473/350 |
| 2003/0195058 | A1 | 10/2003 | Rice et al. | |
| 2005/0009633 | A1 | 1/2005 | Rice et al. | |
| 2005/0009634 | A1 | 1/2005 | Rice et al. | |
| 2005/0187034 | A1 | 8/2005 | Rice et al. | |
| 2005/0192118 | A1 | 9/2005 | Rice et al. | |
| 2005/0239572 | A1 | 10/2005 | Roach et al. | |
| 2005/0255938 | A1 | 11/2005 | Soracco | |
| 2006/0052183 | A1 | 3/2006 | Soracco et al. | |
| 2006/0052184 | A1 | 3/2006 | Soracco et al. | |
| 2006/0068932 | A1 | 3/2006 | Rice et al. | |

* cited by examiner

MULTI-MATERIAL GOLF CLUB HEAD

CROSS-REFERENCE TO RELATED APPLICATIONS

This application is a continuation-in-part of Ser. No. 13/022,577, filed Feb. 7, 2011, which is a continuation of U.S. patent application Ser. No. 11/822,197 filed Jul. 3, 2007, which claims priority to U.S. Provisional Patent Application No. 60/832,228, filed Jul. 21, 2006, which are incorporated herein by reference in their entireties.

FIELD OF THE INVENTION

The present invention relates to a golf club, and, more particularly, the present invention relates to a golf club head having a multi-material construction.

BACKGROUND

Golfers may experience frustrating results when a ball flies off to one side in a hook or a slice or when the ball does not go far enough. Golf club designers have tried some different designs that are meant to be more forgiving to off-center hits or that are meant to increase the ball's initial speed. For example, U.S. Pat. No. 6,991,559 to Yabu seeks a club design that allows flexure of a face plate at impact to improve a restitution coefficient of the club face to increase the traveling distance of the struck ball. Unfortunately, attempts to improve one detail on a golf club can compromise others. For example, a golf club that is designed to have a high restitution coefficient may be found to crack and fatigue at areas on the face above where the face meets the sole. Golfers do not want to purchase golf clubs that break easily through normal use.

SUMMARY

The invention provides a golf club head that uses a light-weight material for part of the body and a strong material for a face-to-sole transition to provide a durable face with a high coefficient of restitution. Use of the light-weight material allows a club designer to include dense materials elsewhere on the club head without a net gain in mass, relative to a club head without such a multi-material construction. Dense material can be included to tune a moment of inertia (MOI) or a location of a center of gravity (CG) of the club head thereby providing a club head that is forgiving to off-center hits. Use of the strong material at the face-to-sole transition area allows a part of the club head to include at least part of the face, a bend down to the sole, and a sole return extending aft of the face. The sole return can be made thin to increase the coefficient of restitution of the face. Moreover, having the material extend continually from the face, through the bend down to the sole, and into the sole return may be found to transmit stresses to a maximum stress region that is isolated on the sole away from score lines, weld lines, and other stress raisers often found on a face and this can prevent material fatigue and failure. Additionally, use of the strong material in the face-to-sole transition area allows the club head to optionally include and support a face insert without compromising durability.

Since the club head body part that includes the face portion, the transition to the sole, and the sole return is associated with increased durability and increased coefficient of restitution, and also since the body part that includes a light-weight material allows for a desirable MOI, CG, or both, a club head of the present invention will launch a ball fast and true without cracking or failing during use.

In certain aspects, the invention provides a golf club head in which a first body part provides a hosel and at least a part of a sole portion of the club head. The first body part includes a front surface bent around a face-sole transition to provide at least a portion of a ball-striking face and at least a part of a downward-facing surface of the sole portion. In some embodiments, the first body part provides the ball-striking face and the entire downward-facing surface of the sole. The club head optionally has a face insert coupled to a peripheral opening in first body part.

The club head also has a low-density body part coupled to a rear surface of the first body part to provide at least a part of the sole portion, a heel portion, and a toe portion of the club head. In some embodiments, the low-density body part extends upwards against the rear surface of the first body part to a top line of the club head. In certain embodiments, the low-density body part extends only partially up the rear surface of the first body part. Preferably, the low-density body part provides at least a third of a volume of the club head or even a majority of the volume.

The club head additionally includes a high-density body part coupled to the sole portion. The first body part may include a strong material such as a metallic material while the second body part could include a less dense material such as a viscoelastic polymer. The high-density body part has a density of at least 7 g/cc and may include a material such as tungsten. In various embodiments, the high-density body part is provided as a plurality of separate pieces, in the form of a bar, a screw, or some other form suited to embodiments disclosed herein. The high-density body part may be coupled to the first body part, the low-density body part, or both.

In related aspects, the invention provides a golf club head that has a first body part with a sole member providing at least a part of a downward-facing surface of a sole portion of the club head, a face member providing at least a part of a ball-striking face and extending down around a face-sole transition and into the sole member, and a hosel extending upwards from the first body part. In some embodiments, the face member includes a peripheral opening with a face insert attached to the face member via the peripheral opening. The club head also includes a second body part coupled to a back surface of the first body part and providing at least part of the sole portion of the club head. In some embodiments, the second part contributes at least a third of a volume of the club head. In some embodiments, the second body part comprises a viscoelastic polymer with a density lower than a density of the first body part. In some embodiments, the second body part cooperates with the first body part to define a cavity open to a back of the club head. The club head may include a recess that extends from the cavity towards the sole. In certain embodiments, a lower-most and upward-facing surface within recess is provided by the first body part.

The sole portion of the club head may further include a third body part. The third body part may include a high density material to optimize a mass distribution property such as MOI or location of CG of the club head.

In other aspects, the invention provides a golf club head that includes a front component and a back component. The front component is formed of a first material and has a face member, a face-sole transition bend at a lower portion of the face member, a sole return extending back from the face-sole transition bend, and a hosel extending from the face member. A front surface of the front component provides at least a portion of a ball-striking face.

The back component is formed of a second material distinct from the first material and attached to a back surface of the face member and cooperating with the front component to provide a main body of the club head. In some embodiments, the first material is stiffer and more dense than the second material. Preferably, the back component provides at least a quarter of a volume of the club head. In certain embodiments, the back component is also attached to an upper surface of the sole return.

In some embodiments, the sole return and back component cooperate to provide a downward facing surface of a sole of the club head, wherein the downward facing surface faces downward when the club head is at address. In certain embodiments, the first component and the second component cooperate to define a cavity in a back of the club head, wherein part of the back surface of the face member is exposed within the cavity.

The club head may further include a high-density component disposed on the main body of the club head. Other aspects of the present invention relate to a golf club head having a multi-material construction. Traditionally, all or a large portion of the club head body is made of a metallic material. While it is beneficial to form some parts of the club head, such as the striking face, hosel, and sole, from a metallic material, it is not necessarily beneficial to form other parts of the club head from the same material. Most of the material beyond what is required to maintain structural integrity can be considered parasitic when it comes to designing a more forgiving golf club. The present invention provides an improved golf club by removing this excess or superfluous material and redistributing it elsewhere such that it may do one or more of the following: increase the overall size of the club head, optimize the club head center of gravity, produce a greater club head moment of inertia, and/or expand the size of the club head sweet spot.

A golf club head of embodiments of the present invention includes a body defining a striking face, a top line, a sole, a back, a heel, a toe, and a hosel. The body is formed of multiple parts. A first body part includes the face, the hosel, and at least a portion of the sole. This first body portion is formed of a metallic material such that it can resist the forces imposed upon it through impact with a golf ball or the golfing surface, and other forces normally incurred through use of a golf club. The striking face of first body part, however, is thinner than conventional golf club heads, while still maintaining sufficient structural integrity, such that mass (and weight) is "freed up" to be redistributed to other, more beneficial locations of the club head.

This golf club head further includes a second body part that is made of a lightweight material, such that it provides for a traditional or otherwise desired appearance without imparting significant weight to the club head. Additionally, the second body part acts as a damping member, which can dissipate unwanted vibrations generated during use of the golf club. The second body part may form part of the club head sole. This second body part also acts as a spacer, allowing the inclusion of one or more dense third body parts. These third body parts can be positioned as desired to obtain beneficial attributes and playing characteristics. Exemplary positions for the third body parts (which may be considered weight members) include low and rear portions of the club head. The club head designer can thus manipulate the center of gravity position, moment of inertia, and other club head attributes.

The face of the club head may be unitary with the first body part, or it may be a separate insert that is joined to the club head body. Providing the face as a separate part allows the designer more freedom in selecting the material of the ball striking face, which may be different than the rest of the club head body. Use of a face insert also allows for the use of a damping member that is retained in a state of compression, which further enhances vibration damping.

Other features, such as an undercut body and a ledge to which the face insert is attached, may also beneficially be included with the inventive club head.

Aspects of the invention provide a golf club head that uses a light-weight material for part of the body and a strong material for a face-to-sole transition to provide a durable face with a high coefficient of restitution. The club head may have a first body part (e.g., metallic material such as an aluminum or a titanium alloy) and a second body part (e.g., viscoelastic material such as polyurethane). Material of the first body part extends down from a face member, bends around a face-sole transition, and continues into a sole return member to provide at least a portion of a ball-striking face and a sole surface. The first body part also provides a hosel. The second body part provides a significant proportion of the volume of the club head (e.g., at least about a third or even a majority). The low-density of the second body part allows for inclusion of one or more high-density third body parts (e.g., a high density material such as tungsten) to optimize mass distribution.

DETAILED DESCRIPTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
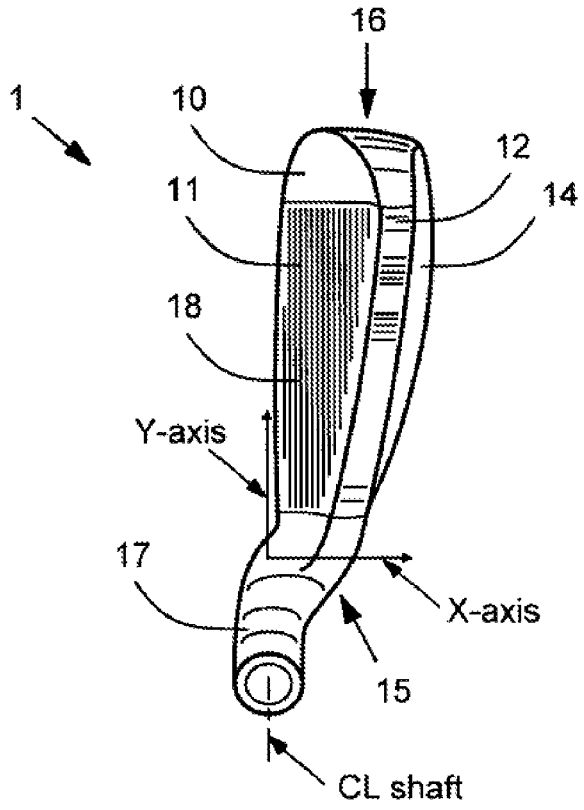
FIG. 1 is a top view of a golf club head of the present invention.
Figure 2:
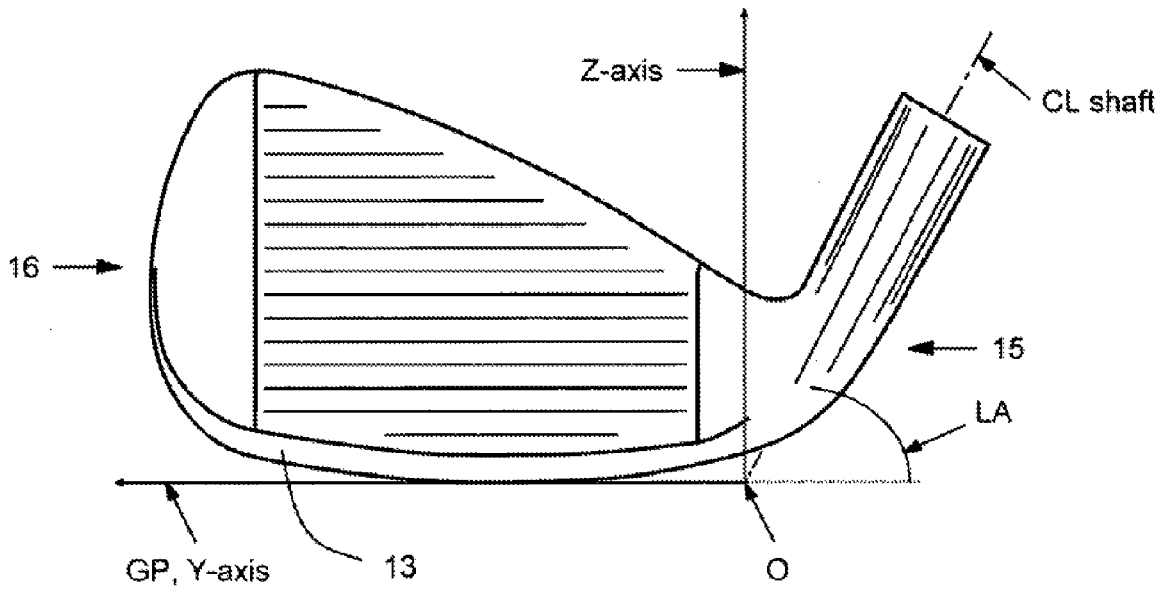
FIG. 2 is a front view of the golf club head of FIG. 1.

FIG. 1 is a top view of a golf club head 1 of the present invention, and FIG. 2 is a front view of the golf club head 1. The golf club head 1 includes a body 10, a front surface 11, a top line 12, a sole 13, a back 14, a heel 15, a toe 16, and a hosel 17. The striking face of the front surface 11 preferably contains grooves 18 therein. Various portions of the club head 1, such as the sole 13, may be unitary with the body 10 or may be separate bodies, such as inserts, coupled thereto. While the club head 1 is illustrated as an iron-type golf club head, the present invention may also pertain to other types of club heads, such as utility-type golf club heads or putter-type club heads.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as vector perpendicular to the X-axis and directed toward the toe 16. A Z-axis is defined as the cross product of the X-axis and the Y-axis.

Figure 3:
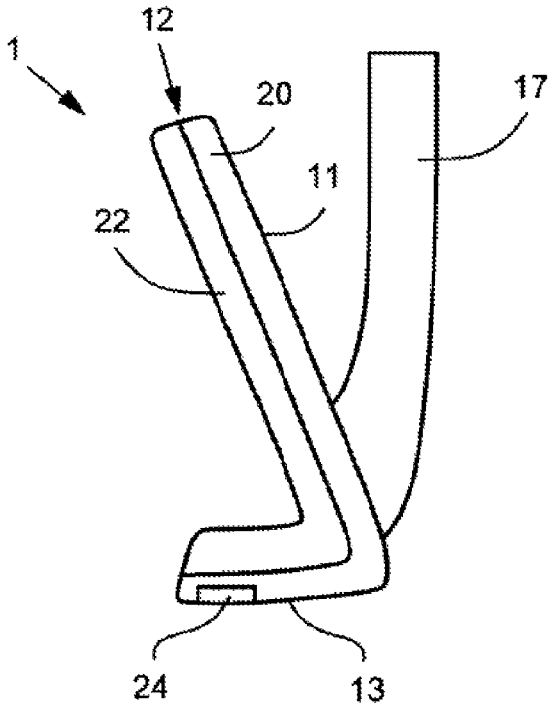
FIG. 3 is a cross-sectional view of a golf club head of the present invention.

FIG. 3 gives a cross-sectional view of a golf club head 1 of the present invention. Club head 1 may comprise two main portions: a first body part 20 and a second body part 22. Optionally, a third body part 24 may be included. The first body part 20 preferably includes the hosel 17, the face 11, and at least a portion of the sole 13, and is formed of a material that is able to withstand forces imposed upon it during normal use of the golf club. Such forces may include those resulting from striking the golf ball and the playing surface. Similarly, the material should allow the lie angle, loft angle, and/or other club head attributes to be adjusted, such as by bending of the hosel 17. Preferred materials for the first body part 20 include ferrous alloy, titanium, titanium alloy, steel, and other metallic materials. This portion of the club head 1 may be formed by forging or casting as a single piece. Alternatively, this portion of the club head 1 may be formed by combining two or more separate pieces. For example, the face 11 may be a face insert that is coupled to a peripheral opening in the remaining portion of the first body part 20.

The second body part 22 is coupled to a rear surface of the first body part 20, preferably opposite the face 11, and forms a middle portion of the club head 1. This portion of the club head 1 preferably is formed of a lightweight material. Thus, this portion of the club head 1 does not have a significant effect on the physical characteristics of the club head 1. Preferred materials for the second body part 22 include a bulk molding compound, rubber, urethane, polyurethane, a viscoelastic material, a thermoplastic or thermoset polymer, butadiene, polybutadiene, silicone, and combinations thereof. Through the use of these materials, the second body part 22 may also function as a damper to diminish vibrations in the club head 1, including vibrations generated during an off-center hit.

The third body part 24 is coupled to at least one of the first and second body portions 20, 22. The third body part 24 may be a single piece, or it may be provided as a plurality of separate pieces that are attached to the first and/or second body portions 20, 22. The third body part 24 preferably is positioned in the sole 13 or rear of the club head 1. This portion of the club head 1 preferably is formed of a dense, and more preferably very dense, material. High density materials are more effective for affecting mass and other properties of the club head 1, but stock alloys may alternatively be used. Preferred materials for this portion of the club head 1 include tungsten, and a tungsten alloy, including castable tungsten alloys. The density of the third body part 24 preferably is greater than 7.5 g/cc, and more preferably is 10 g/cc or greater. The density of the third body part 24 should be greater than the density of the first body part 20, which in turn should be greater than the density of the second body part 22. The third body part 24 can be provided in a variety of forms, such as in the form of a bar or one or more weight inserts. The third body part 24 can be formed in a variety of manners, including by powdered metallurgy, casting, and forging. An exemplary mass range for the third body part 24 is 2-30 grams. Alternatively, the third body part 24 may comprise 10% or more of the overall club head weight.

It will be appreciated from FIG. 3 that first body part 20 can be included as a front component formed of a first material and comprising a face member, a face-sole transition bend at a lower portion of the face member, a sole return extending back from the face-sole transition bend, and a hosel extending from the face member. A front surface of the front component provides at least a portion of a ball-striking face. Second body part 22 can be provided as a back component formed of a second material distinct from the first material and attached to a back surface of the face member and cooperating with the front component to define a main body of the club head. The main club head body can be taken to refer to the club head less the hosel. The face member, the sole return, or both can be made thin due to the inclusion and support from the back component. As portions of the front component are made thinner, second component will provide correspondingly greater share of the volume of the main club head body. In some embodiments, the second component provides at least 51% (i.e., a majority) of the main club head body. In certain embodiments, the second component provides a majority of the club head by volume.

The multi-part designs described herein allow for the removal of unneeded mass (and weight), which can be redistributed to other, more beneficial locations of the club head 1. For example, this "freed" mass can be redistributed to do one or more of the following, while maintaining the desired club head weight and swingweight: increase the overall size of the club head 1, expand the size of the club head sweet spot, reposition the club head center of gravity (COG), and/or produce a greater moment of inertia (MOI) measured about either an axis parallel to the Y-axis or Z-axis passing through the COG. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits because less energy is lost during impact from club head twisting. Moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI. The face portion of the first body part 20 preferably is provided as thin as possible, while still maintaining sufficient structural integrity to withstand the forces incurred during normal use of the golf club and while still providing a good feel to the golf club. The second body part 22 provides for a traditional or otherwise desired appearance without adding appreciable weight. The second body part 22 also acts as a spacer, allowing the third body part 24 to be positioned at a desired distance rearward from the face 11, which in turn repositions the COG rearward and/or lower with respect to traditional club heads. By so positioning the center of gravity, the golf club is more forgiving. The COG position may be lowered further by removing unnecessary mass from the top line 12. Preferred methods of doing so are disclosed in pending U.S. patent application Ser. No. 10/843,622, published as Publication No. US2005/0255938, Ser. No. 11/266,172, published as Publication No. US2006/0052183, and Ser. No. 11/266,180, published as Publication No. US2006/0052184, which are incorporated herein in their entireties.

The third body part 24 may be positioned so that a spring-mass damping system is formed. One such location is shown by the dashed lines of FIG. 4 and indicated by reference 24'. With the face 11 acting as the vibrating body, the second body part 22 acts as the spring, and the third body part 24 acts as the ground.

Figure 4:
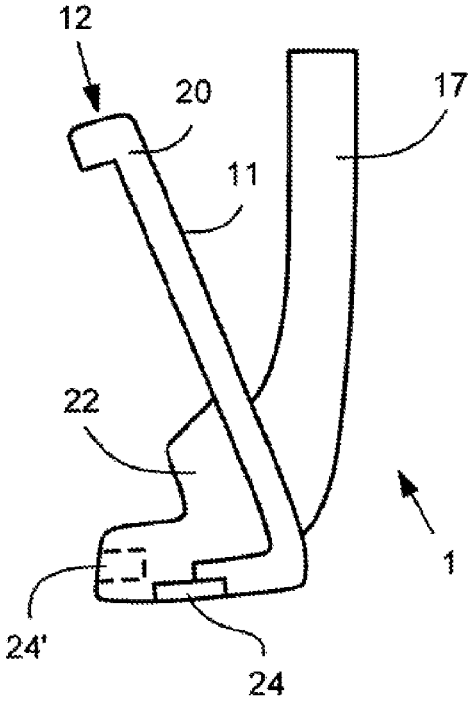
FIG. 4 is a cross-sectional view of a golf club head of the present invention.

In the illustrated embodiment of FIG. 3, the first body part 20 includes the face 11 and the entire sole 13. The second body part 22 is coupled to the rear surface of the first body part 20, and extends all the way to the top line 12. The third body part 24 is coupled to the first body part 20 in the sole 13 of the club head 1. In this illustrated embodiment, the third body part 24 is positioned only in the sole 13. Another embodiment is illustrated in FIG. 4. Here, the second body part 22 extends only partially up the rear surface of the first body part 20 and gives the club head 1 the appearance of a cavity back club head. In this embodiment, the sole 13 is formed by both the first and second body portions 20, 22, and the third body part 24 is coupled to both the first and second body portions 20, 22.

The club head 1 may be assembled in a variety of manners. One preferred assembly method includes first forming the first and third body portions 20, 24, such as by casting or forging. These portions 20, 24 may then be placed in a mold, and then the material forming the second body part 22 inserted into the mold. Thus, the second body part 22 is molded onto and/or around the first and third body portions 20, 24, creating the final club head shape. The second body part 22 may thus be bonded to either or both of the first and third body portions 20, 24. This is referred to as a co-molding process.

FIG. 4 illustrates a golf club head 1 that includes a sole return extending back from a bend at a bottom of a face part. In certain embodiments, club head 1 includes a first body part 20 providing a hosel 17 and at least a part of a sole portion 13 of club head 1. The first body part 20 includes a front surface bent around a face-sole transition and provides at least a portion of a ball-striking face 11 and at least a part of a downward-facing surface of the sole portion 13. Club head 1 may also include a low-density body part 22 (e.g., made with a viscoelastic polymer) coupled to a rear surface of the first body part 20 and providing at least a part of the sole portion 13 as well as a heel portion and a toe portion of the club head. As shown in FIG. 4, low-density body part 22 extends only partially up the rear surface of the first body part 20. A high-density body part 24 is preferably coupled to sole portion 13.

In some embodiments, first body part 20 comprises a metallic material. Club head 1 may include a face insert that is coupled to a peripheral opening in first body part 20. In certain embodiments, high-density body 24 part has a density of at least 7 g/cc. High-density body part 24 may include tungsten. High-density body part 24 may be present in the form of a bar, discs, cylinders, screws, amorphous blobs, a contoured panel within a surface of club head 1, or any other suitable form.

FIG. 4 may also be viewed as showing that first body part 20 can be included as a front component formed of a first material and comprising a face member, a face-sole transition bend at a lower portion of the face member, a sole return extending back from the face-sole transition bend, and a hosel extending from the face member. A front surface of the front component provides at least a portion of a ball-striking face. Second body part 22 can be provided as a back component formed of a second material distinct from the first material and attached to a back surface of the face member and extending upwards over only a portion of the front component (i.e., the top portion of the back surface of the front component is exposed as an exterior surface of club head 1 and not covered by the back component). This may be preferred to provide a very low CG.

Figure 5:
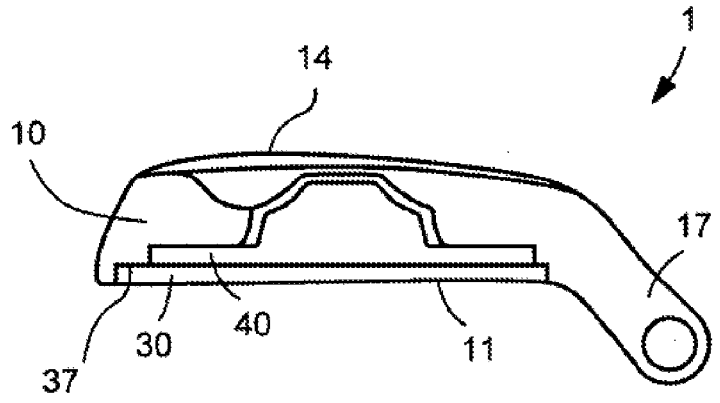
FIG. 5 is a top view of a golf club head of the present invention.

FIG. 5 is a top view of a golf club head 1 of the present invention. In this illustrated embodiment, the club head 1 includes a body 10 and a face insert 30 having a striking face 11. The body 10 defines a front opening 35, and has a ledge 37 adjacent the front opening 35. The ledge 37 may extend only partially around the perimeter of the front opening 35 or may be provided as several discrete sections, but preferably the ledge 37 extends completely around the perimeter of the face opening 35 (360°). The face insert 30 is coupled to the body 10 at the ledge 37. Preferably, the face insert 30 and the body 10 are in contact only along the ledge 37, thus minimizing the metal-to-metal contact between the two elements.

Figure 16:
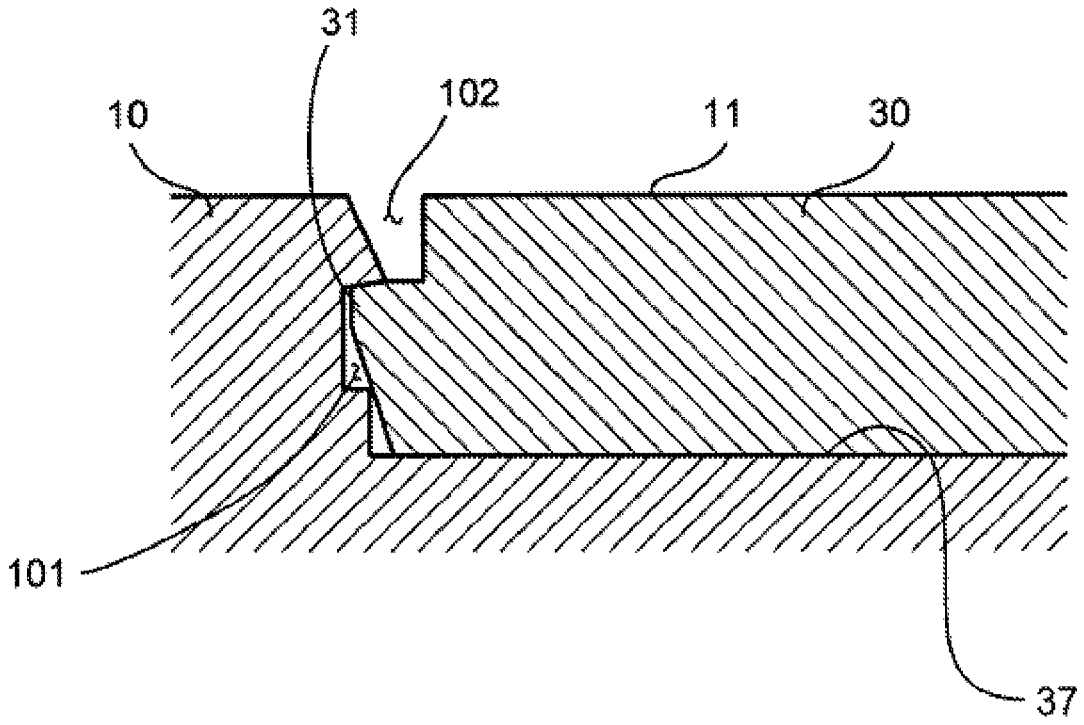
FIG. 16 is a partial cross-sectional view of a golf club head of the present invention illustrating one way of connecting a face insert to the club head body.

The face insert 30 to body 10 connection may be facilitated by the use of a groove and lock tab configuration. Such a configuration is shown in FIG. 16, which is a partial cross-sectional view of a golf club head of the present invention. The body 10 at ledge 37 defines a groove 101 therein that extends inward into the body 10. The face insert 30 includes a tab 31 corresponding to the groove 101. When the face insert 30 is inserted into the body opening 35, the tab 31 contacts the side wall of the ledge 37. When enough force is exerted, either or both of the tab 31 and the upper portion of the ledge 37 side wall deform, preferably elastically deform, allowing the face insert 30 to be inserted to its designed final position (such as being seated at ledge 37). When in this final position, the tab 31 passes the upper ledge wall portion and snaps out into place within the groove 101. Because the upper ledge wall portion now extends over the insert tab 31, the face insert 30 is retained in position. This tab-groove retention scheme could be provided around the entire perimeter of the face insert 30, or more preferably may be positioned in discrete locations around the insert perimeter. It is possible that instead of the tab 31 being part of the face insert 30 and the groove being defined by the body 10, the opposite construction, wherein the body 10 contains a tab and the face insert 30 contains a corresponding groove, may also be used. Furthermore, these varying constructions could both be employed on a single club head 1.

Figure 17:
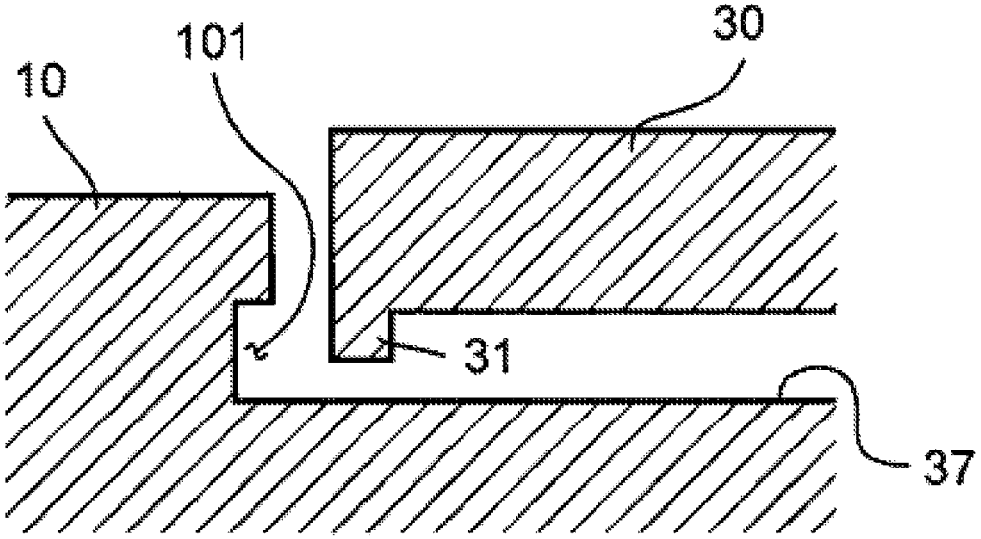
FIG. 17 is a partial cross-sectional view of a golf club head of the present invention illustrating another way of connecting a face insert to the club head body.

FIG. 17 illustrates an alternate groove and lock tab configuration. In this illustrated embodiment, in which the face insert 30 has not yet been coupled to the club head body 10, the face insert 30 contains tabs 31 extending rearward from perimeter edges thereof. The club head body 10 contains grooves 101 extending in a direction substantially perpendicular to the ledge 37, such as toward the heel 15 and toe 16. When the face insert 30 is coupled to the club head body 10, tabs 31 are plastically deformed into the corresponding grooves, locking the face insert 30 to the body 10.

An adhesive or other joining agent may be used to further ensure that the face insert 30 is retained as intended. The face insert 30 and/or upper ledge wall portion may be designed to define a groove 102 around the face insert 30 to provide a run-off or collection volume for any excess adhesive. This not only provides a pleasing aesthetic appearance in the finished golf club, but also beneficially reduces assembly and manufacturing time. Exemplary ways of creating the groove 102 include by angling the upper portion of the ledge side wall and/or by stepping-in the outer portion of the face insert 30.

Figure 13:
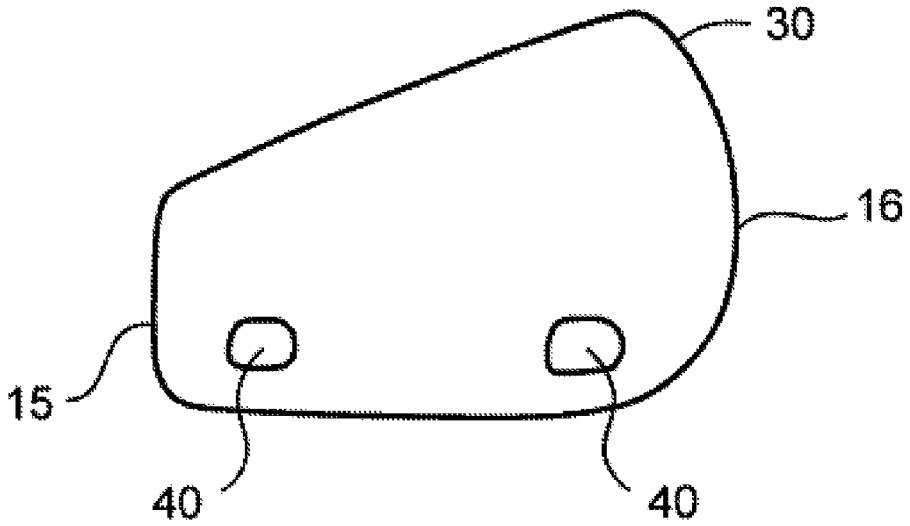
FIG. 13 is a rear view of a face insert with dampers positioned to contact its rear surface at heel and toe portions thereof.
Figure 14:
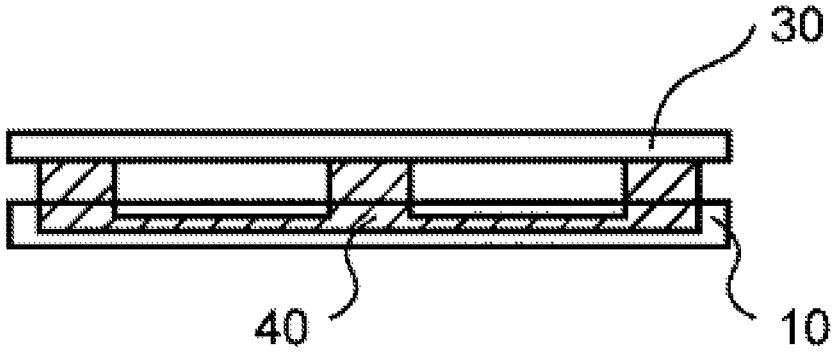
FIG. 14 is a cross-sectional top view of a damping member having a plurality of fingers extending outward to contact the rear surface of the face at heel, toe, and central portions thereof.

A damping member 40 is positioned intermediate the body 10 and the face insert 30. As the face 30 deflects during use, the deflection forces are imparted to the damping member 40, which dissipates such forces and reduces the resulting vibration. This lessens and may eliminate vibrations—such as those incurred during an off-center hit—being transmitted through the club head and shaft to the golfer, resulting in a club with better feel and a more enjoyable experience to the golfer. Preferably, the damping member 40 is held in compression between the body 10 and the face 30, which enhances the effectiveness of the vibration damping aspects of the damping insert 40. Preferably, the damping member 40 is positioned such that it is in contact with a rear surface of the face insert 30 opposite the club head sweet spot. The damping member 40 may contact the rear surface of the face insert 30 at other locations, such as the heel 15 or toe 16 or top line 12, in addition to or instead of at the sweet spot. FIG. 13 illustrates a rear view of a face insert 30 with dampers 40 positioned to contact the rear surface of the face 30 at heel 15 and toe 16 portions thereof. FIG. 14 illustrates a cross-sectional top view of a damping member 40 having a plurality of fingers extending outward to contact the rear surface of the face 30 at heel 15, toe 16, and central portions thereof. It should be noted that while the entire damping member 40 is shown in FIG. 14, a portion of it would actually be blocked from view by the body 10. Depending upon the vertical placement of the damping member 40, the central finger may be in contact with the face insert 30 opposite the club head sweet spot. Recesses, indentations, or the like may be provided in the rear surface of the face insert 30 to position and help retain the damping members 40 in place. It is beneficial to provide a damping member 40 at these locations because impacts (such as with a golf ball) in these areas create more vibration than center impacts by virtue of the impact being farther from the club head center of percussion.

As shown for example in FIG. 14, there may be a gap, such as due to an undercut, making the damping member 40 visible in the finished club head. Thus, the damping member(s) 40 may be "free floating" with no portion of the member(s) 40 in contact with the face 30 being constrained against expansion due to compression. In other words, no portion of the club head body 10 is in contact with the damping member(s) 40 at its distal end adjacent to and abutting the face 30; the damping member(s) 40 is open 360° to the environment at its distal end. This may enhance their vibration damping effect. As further shown in FIG. 14, the damping member(s) 40 may take the form of a plurality of fingers of suspended, compressed damping material contacting the rear surface of the face 30.

Figure 6:
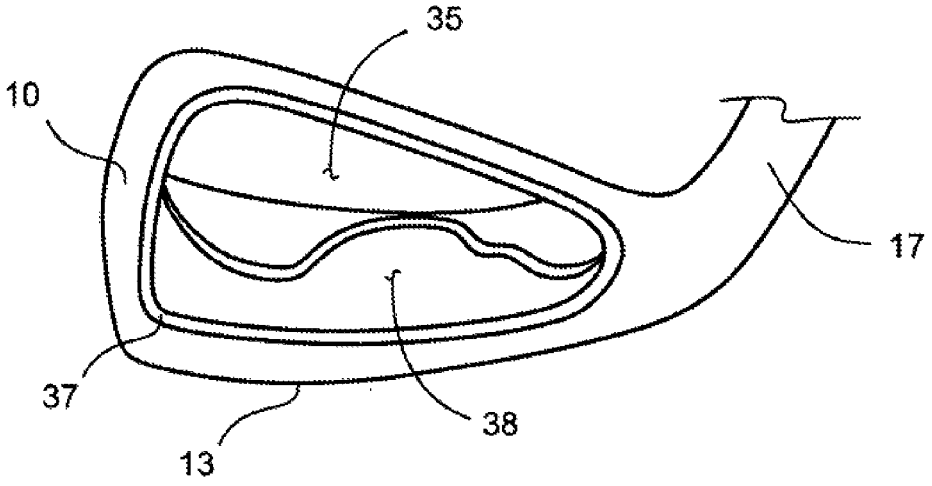
FIG. 6 is a front view of the body member of the golf club head of FIG. 5.

FIG. 6 is a front view of the body 10 of the golf club head 1 of FIG. 5 without the face insert 30 or damping member 40 in place. Through the front opening 35, it can be seen that the body 10 preferably includes an undercut 38. Inclusion of the undercut 38 removes additional material from the club head body 10, further enhancing the weight distribution, COG location, MOI, and other benefits discussed above. The undercut can extend 360° around the face perimeter, or can extend to any desired fraction thereof, such as 90° or less. In the illustrated embodiment of FIG. 6, the undercut 38 extends from a mid-heel area to a mid-toe area. The undercut preferably extends toward the sole 13 in a lower portion of the body 10. Preferably, the damping member 40 is positioned to at least partially fill the undercut 38.

In one preferred embodiment, the COG is located 17.5 mm or less above the sole 13. Such a COG location is beneficial because a lower COG facilitates getting the golf ball airborne upon being struck during a golf swing. Also, the MOI measured about a vertical axis passing through the club head COG when grounded at the address position is preferably 2750 gcm.sup.2 or greater. This measurement reflects a stable, forgiving club head.

These attributes may be related conveniently through the expression of a ratio. Thus, using these measurements, the golf club head has a MOI-to-COG ratio of approximately 1600 g/cm or greater. As used herein, "MOI-to-COG ratio" refers to the MOI about a vertical axis passing the club head COG when grounded at the address position divided by the COG distance above the sole 13.

Preferred materials for the body 10 and the face insert 30 are discussed above with respect to the first body part 20, and preferred materials for the damping member 40 are discussed above with respect to second body part 22. Additionally, when a face insert is used, it preferably may comprise a high strength steel or a metal matrix composite material, a high strength aluminum, or titanium. A high-strength steel typically means steels other than mild low-carbon steels. A metal matrix composite (MMC) material is a type of composite material with at least two constituent parts, one being a metal. The other material may be a different metal or another material, such as a ceramic or organic compound. These materials have high strength-to-weight ratios that allow the face insert 30 to be lighter than a standard face, further freeing mass to be beneficially repositioned on the club head 1 and further enhancing the playability of the resulting golf club. It should be noted that when a face insert is used, material selection is not limited by such constraints as a requirement for malleability (such as is often the case when choosing materials for the body and hosel). If a dissimilar material with respect to the body 10 is chosen for the face insert 30 such that welding is not a readily available coupling method, brazing, explosion welding, and/or crimping may be used to couple the face insert 30 to the body 10.

The face insert 30 may be formed of titanium or a titanium alloy. This face insert 30 may be used in conjunction with a stainless steel body 10, an exemplary stainless steel being 17-4. As these two materials are not readily joined by welding, crimping is a preferred joining method. This typically includes formation of a raised edge along all or portions of the face opening perimeter, which is mechanically deformed after the placement of face insert, locking the two together. The face insert may be beveled or otherwise formed to facilitate crimping. One or more machining/polishing steps may be performed to ensure that the strike face is smooth.

Alternatively, the face insert 30 may be formed of a stainless steel, which allows the face insert 30 and the body 10 to be readily joined via welding. One preferred material is 1770 stainless steel alloy. As this face insert material is more dense than titanium or titanium alloy, the resulting face insert 30—body 10 combination has an increased weight. This may be addressed by increasing the size (i.e., the volume) of the undercut 38, such that the overall size and weight of the club heads are the same.

This embodiment of the club head 1 may be assembled in a variety of manners. One preferred method of assembly includes casting, forging, or otherwise forming the body 10 and the face insert 30 (in separate processes). The face insert 30 may be formed such that it has one or more raised areas 32 on a rear surface thereof. (See FIG. 7, which is a side view of the golf club head 1 of FIG. 5 when cut (substantially) in half approximately through a vertical centerline of the club head 1.) These raised areas 32 are in at least partial contact with the damping member 40 when the club head 1 is assembled, and act as guide walls to help orient the damping member 40 into the desired proper position. The damping member 40 may be molded with the body 10 and face insert 30 in place as discussed above. Alternatively, the damping member is positioned in the desired location within the body 10 before the face insert 30 is coupled to the ledge 37 or the damping member 40 is put into place after the face 30 is attached to the body 10. Preferably, the damping member 40 is larger than the resulting volume of its location in the assembled club head 1. Thus, when the face insert 30 is positioned along the ledge 37 within the face opening 35, the damping member 40 is compressed, and is retained in a state of compression in the assembled club head 1 to further enhance vibration dissipation.

Figure 8A:
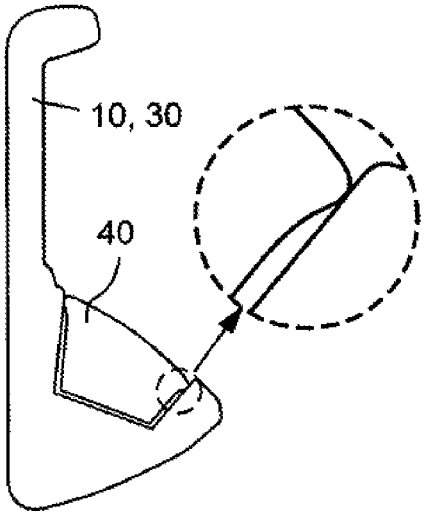
FIGS. 8A, 8B, and 8C illustrate additional methods of connection the damping member to the club face and/or body of the club head of FIG. 5.
Figure 8B:
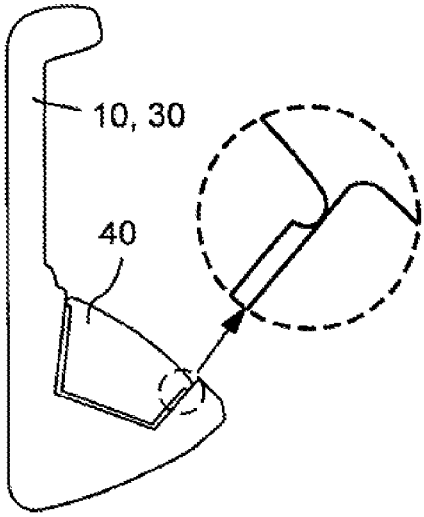
Figure 8C:
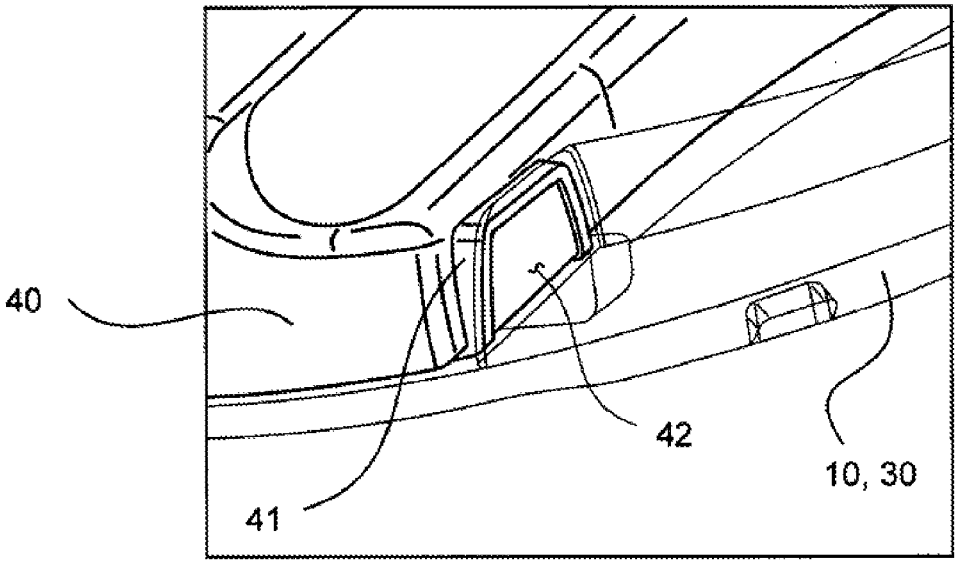

FIGS. 8A, 8B, and 8C illustrate additional methods of connecting the damping member 40 to the club face 30 and/or body 10. In the illustrated embodiments of FIGS. 8A and 8B, the damping member 40 flairs outward at its upper end. This increases the frictional forces between it and the face 30 and/or the body 10, substantially locking the damping member 40 in place. It should be noted that the spaces or empty volumes shown in FIGS. 8A and 8B are provided for purposes of illustration and may likely not be present in the assembled club head 1. In the illustrated embodiment of FIG. 8C, the damping member 40 is provided with a projection 41 and the face insert 30 and/or body 10 is provided with a corresponding chamber 42 into which the projection 41 is retained, substantially locking the damping member 40 in place. While only one projection 41 and corresponding chamber 42 are shown, two or more such projections-chambers 41, 42 can be used.

The damping member 40 may comprises a plurality of materials. For example, the damping member 40 may include a first material in contact with the face insert 30 and a second material in contact with the body 10. The materials of the damping member may have varying physical characteristics, such as the first material (adjacent the face insert 30) being harder than the second material (adjacent the body 10). The differing materials may be provided in layer form, with the layers joined together in known fashion, such as through use of an adhesive or bonding.

The damping member 40 may comprise a material that changes appearance when subjected to a predetermined load. This would provide the golfer with visual confirmation of the damping at work.

Figure 7:
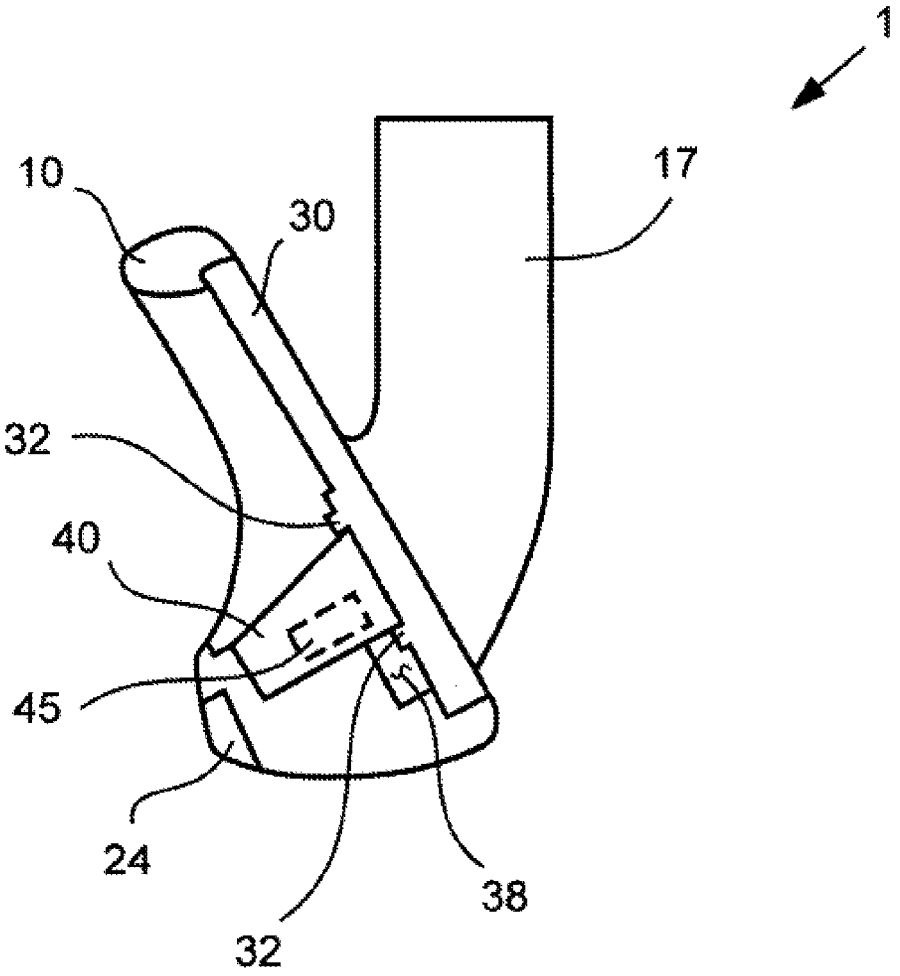
FIG. 7 is a side view of the golf club head of FIG. 5 when cut in half.

As shown in FIG. 7, the club head 1 may include a weight member 24, which is discussed above in terms of the third body part 24. The weight member 24 may be cast or forged in place during formation of the body 10, or may it may be added after the body 10 has been formed, such as by welding or swaging it in place. As shown by the dashed lines in FIG. 7, the damping member 40 may be provided with one or more weight members 45 having similar properties to the weight member 24. The weight member(s) 45 may be encapsulated within the damping member 40. An exemplary mass range for both weight members 24, 45 is 2-30 grams. Alternatively, the weight members 24, 45 may comprise 10% or more of the overall club head weight, individually or collectively. Upon contact with a golf ball, the encapsulated weight 45 exerts a force on the material of the damping member 40, causing it to deform. This deformation further dissipates vibrations generated during use of the golf club. Preferably, the damping member 40, with or without inclusion of the weight member 45, is positioned between the body 10 and the face insert 30 such that the loading on it will be consistent, regardless of the golf ball impact location on the striking face 11.

Figure 9:
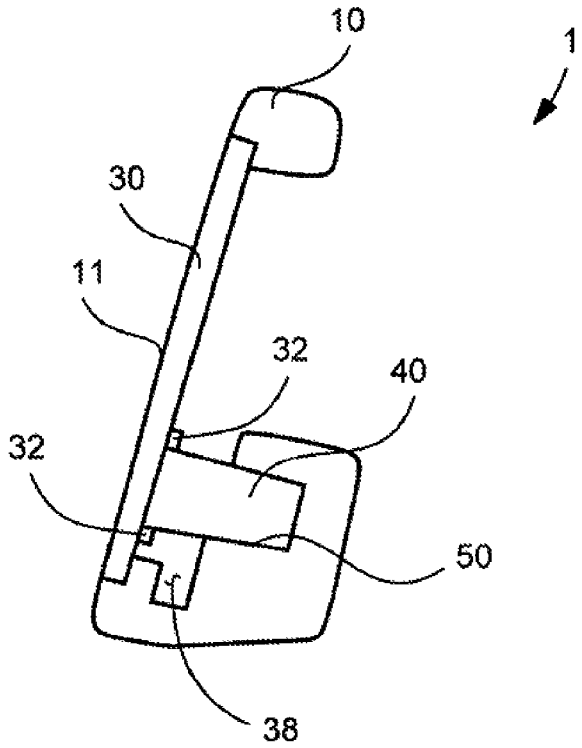
FIG. 9 is a cross-sectional view through a golf club head of the present invention.

FIG. 9 is a cross-sectional view through a golf club head 1 of the present invention. In this illustrated embodiment, guides 32 hold the damping member 40 in place adjacent the rear surface of the face insert 30, and the rear portion of the body 10 includes a chamber 50 into which the rear portion of the damping member 40 is positioned. In this manner, it is not necessary to couple the damping member 40 to the face insert 30 or the body 10. Inclusion of the guides 32 is optional, as the damping member 40 may be retained in the desired position by the chamber 50 alone. Additionally, the contacts between the damping member 40 and the body 10 and/or the face insert 30 can be lubricated so that frictional forces are minimized. If a weight member is used within or adjacent to the damping member 40 (an example of the latter being inclusion of a separate weight member adjacent a rear surface of the damping member 40 or a separate weight member intermediate layers of damping material), the contacts between the weight member and the damping member 40 can also be lubricated to further reduce frictional forces.

Figure 10:
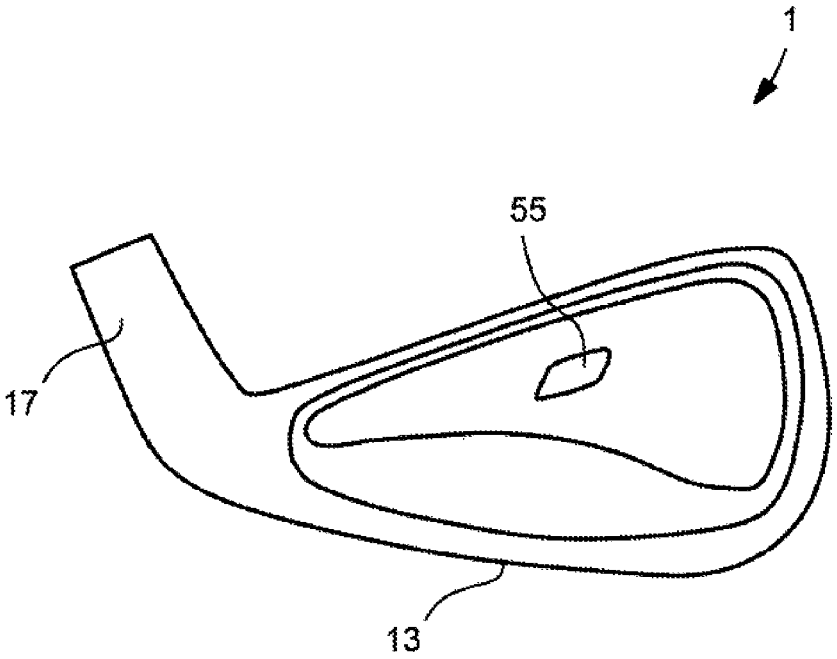
FIG. 10 is a rear view of a golf club head of the present invention.

FIG. 10 is a rear view of a golf club head 1 of the present invention. The rear surface of the face includes a projection 55 extending outward from a rear surface thereof. In the illustrated embodiment, the club head 1 is a cavity back and the projection 55 is located within the cavity, such that it is visible in the assembled club head 1. Preferably, the projection 55 has the shape of a rhombus. The benefits of including the projection 55 are discussed in U.S. Pat. No. 7,029,403 and U.S. Patent Application Publication Nos. 2006/0068932, 2005/0192118, 2005/0187034, 2005/0009634, 2005/0009633, and 2003/0195058, each of which is incorporated herein by reference. The rear surface of the face preferably may be machined to form the projection 55 and/or other features.

As discussed above, incorporating a face plate 30 formed of a relatively lightweight material provides certain benefits to the resulting golf club. Aluminum (including aluminum alloys) is one such lightweight material. M-9, a scandium 7000-series alloy, is one preferred aluminum alloy. Using a face insert 30 that comprises aluminum with a steel body 10, however, can lead to galvanic corrosion and, ultimately, catastrophic failure of the golf club. To realize the benefits both of using a face insert 30 comprising aluminum and a body 10 comprising steel (such as a stainless steel), without being susceptible to galvanic corrosion, a layered face insert 30 may be used.

Figure 11:
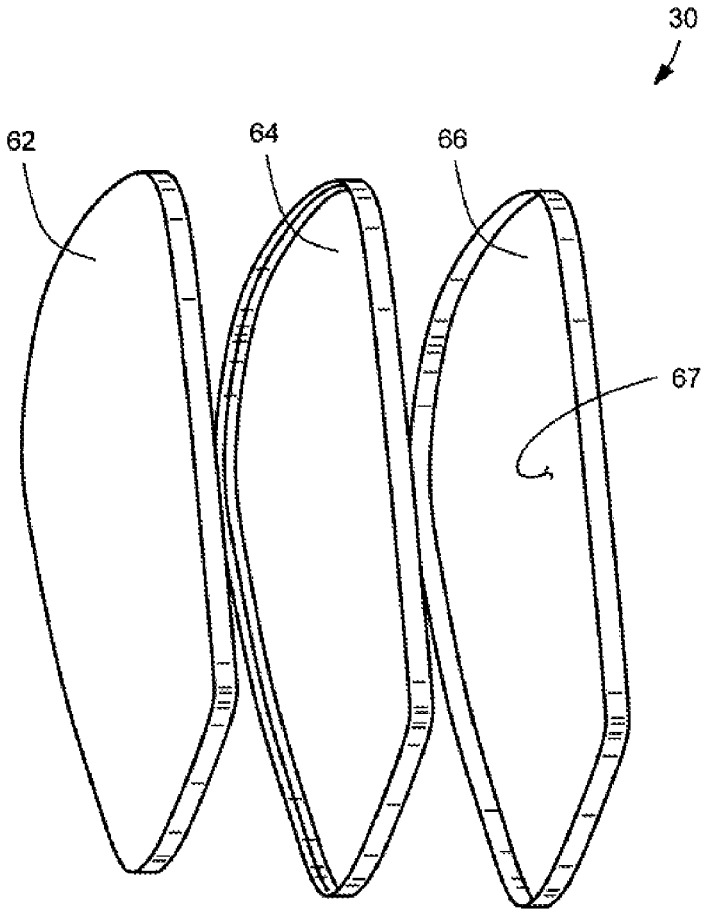
FIG. 11 is a perspective view of a layered face insert of the present invention.

FIG. 11 illustrates such a layered face insert 30. There are three main components to this layered face insert 30. A first layer 62 is provided, and preferably is formed of a high strength, lightweight metallic (preferably an aluminum alloy) or ceramic material. This first layer 62 includes a surface that functions as the strike face 11. (While no grooves 18 are shown in the illustrated embodiment of FIG. 11 for the sake of clarity, it should be recognized that grooves of varying design can be included.) The first layer 62 is lighter than typical face inserts for the beneficial reasons discussed above.

A second layer 64 is provided to the rear of and abutting the first layer 62. This layer 64 is formed of a lightweight material, such as those discussed above with respect to the second body part 22. This layer 64 provides the desired sizing and damping characteristics as discussed above. The first and second layers 62, 64 may be joined together, such as via bonding. This second layer 64 may contain a lip extending outward around its perimeter, thus forming a cavity, into which the first layer 62 may be retained. In this manner, the metallic material of the first layer 62 may be isolated from the material of the club head body 10, and galvanic electrical flow between the club head body 10 and the metallic portion(s) of the face insert 30 is prevented.

The third main component of the layered face insert 30 is a foil 66. The foil 66 is very thin and may be formed of a variety of materials, including materials that act to prevent galvanic corrosion. The foil 66 includes a pocket or cavity 67 sized to envelop the first and second layers 62, 64. The foil 66 may be joined to the first and second layer 62, 64 combination via an adhesive or other means, or simply by being pressed or otherwise compressed against the rear and perimeter surfaces of the second layer 64. The layered face insert is then joined to the club head body 10 in known manner, such as by bonding and/or crimping.

Figure 12:
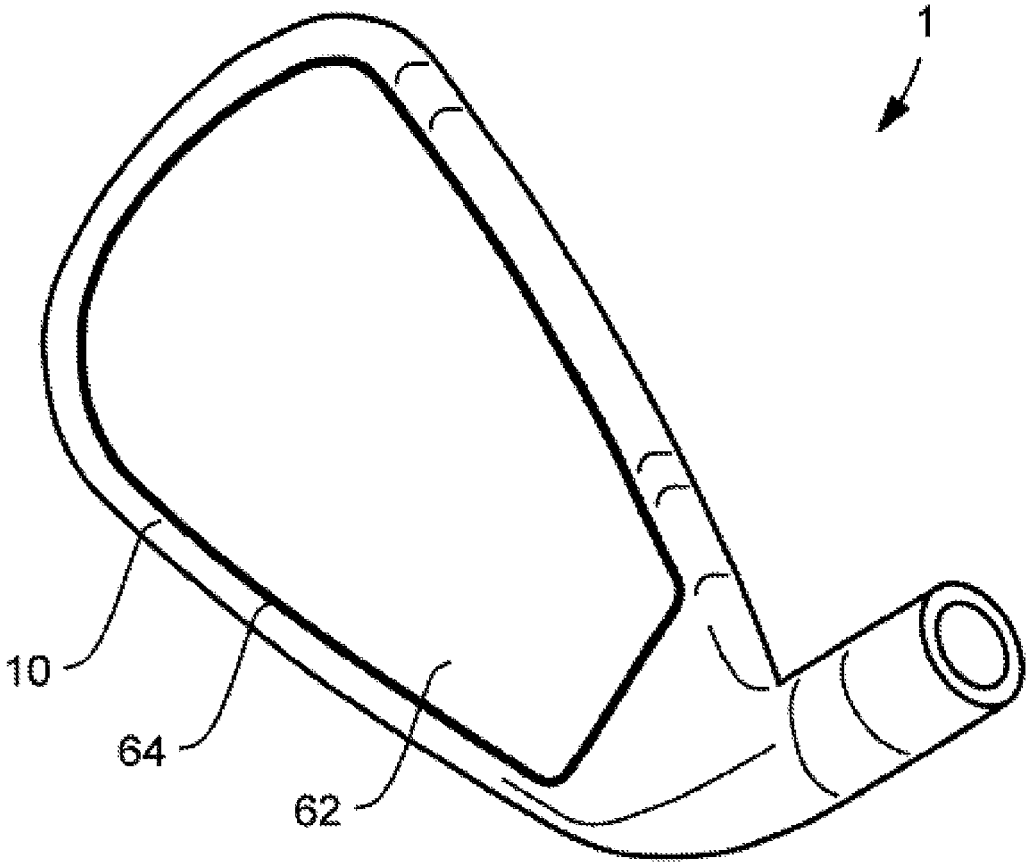
FIG. 12 is a front view of a golf club head of the present invention employing the layered face insert of FIG. 11.

FIG. 12 shows a front view of a golf club head 1 employing the layered face insert 30. Inclusion of the foil 66 is optional.

Other means for preventing galvanic corrosion may also be used. These may include coating the face insert 30 or the corresponding structure of the body 10, such as ledge 37. Preferred coating methods include anodizing, hard anodizing, ion plating, and nickel plating. These alternate corrosion prevention means may be used in conjunction with or alternatively to the three-part face insert construction described herein.

The rear surface of the second layer 64 may be provided with a contoured surface. One such surface being, for example, a logo or other manufacturer indicium. In certain embodiments, the rear surface of the face insert 30 is visible. As the foil layer 66 is very thin and mated to the rear surface of the second layer 64, the textured rear surface of the second layer 64 is visible in these embodiments. The foil 66 may be colored or otherwise decorated to enhance the visibility of the logo, indicium, or other texture of the second layer 64. If the foil 66 is colored or otherwise decorated prior to be joined to the layers 62, 64, the textured surface can be colored and otherwise enhanced without costly and time consuming processes, such as paint filling, that are typically required. A plurality of indicia, examples including manufacturer and product line identifiers, preferably may be included in this manner.

Figure 15:
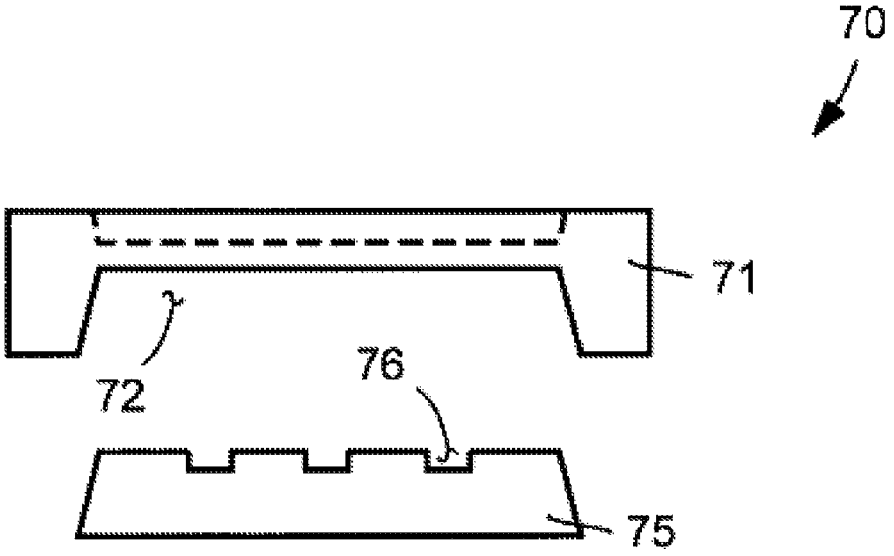
FIG. 15 is an exploded side view of a multi-part medallion of the present invention.

Alternatively or in addition to using a contoured rear second layer surface and the foil 66 to provide indicia, a medallion may be used. An exploded side view of a preferred medallion 70 is shown in FIG. 15. This medallion 70 includes a base member 71 formed of a resilient material, such as those discussed above with respect to the damping members 40 and the second body part 22. Either of these previously discussed components may have the additional function of serving as the base member 71. The medallion 70 further includes an indicia member 75, which may be formed from a variety of materials, such as a low density polycarbonate resin, a low density metallic material, or acrylonitrile butadiene styrene (ABS). The main requirement for the indicia member 75 material is that it exhibit some amount of rigidity so that the indicia is not distorted. The indicia member 75 may be hollow. The indicia member 75 includes a top surface that may contain one or more grooves 76. These grooves 76 may be used to form the indicia, and they may be paint-filled. The indicia member 75—including the grooves 76, if present—can be formed in a variety of manners. One preferred manner is electroforming, which is a readily repeatable, high-tolerance process that results in a part with a high surface finish. This process is readily used with complex configurations, and the resulting part is not subject to shrinkage and distortion associated with other forming techniques.

The base member 71 defines a chamber 72 into which the indicia member 75 is positioned and retained. Adhesive, epoxy, and the like may be used to join the base member 71 and the indicia member 75. Corresponding walls of the chamber 72 and the indicia member 75 may be sloped to lock the indicia member 75 in place within the chamber 72. As indicated by the dashed lines in FIG. 15, the base member 71 contains an opening through which the indicia member 75—including the paint-filled grooves 76, if present—can be viewed. The indicia member 75 may extend through the opening such that its upper surface is flush with the base member upper surface. Alternatively, the indicia member 75 does not extend completely to the base member upper surface; rather, there may be a void between the upper surfaces of the base member 71 and the indicia member 75. This void can be left empty, or it may be filled with a clear material, such as a transparent polycarbonate, which will act to protect the indicia.

In related aspects and embodiments, the invention provides an iron with L-cup, or L-wrap, construction in which a first body part includes a face member transitioning into a sole member through a bend. This construction employs the insight that one way to increase ball speed off the face of an iron is to decrease the thickness of a sole return just aft of the face (where sole return may be taken to describe a member extending backwards from a ball striking face and near or in a sole of a club head). As this area gets thinner it flexes more during impact, the more this area flexes the more the face can flex. With increase face flexure comes increased ball speed. However, prior art irons with relatively high thickness in the sole return just aft of the face typically show maximum load regions on the outward portion of the striking face. This area of the face typically contained a weld line, score lines, or other features that cause stress raisers. A stress raiser located in a maximum stress region can cause durability issues. As known in metallurgy, for example, a stress raiser may be a discontinuity in contour or structure that causes localized stress concentration.

A stress raiser is avoided by a body part in which a material of or supporting the striking face continues into a sole return (aka an "L-wrap" construction). Where the material is monolithic, with no gaps, joints, or seams, from a lower portion of the face area, around a bend, and into the sole area, stress is communicated away from face. Without being bound by any mechanism of action, it is theorized that shock waves propagate away from ball striking face and into the nether regions of the sole return. In multi part constructions, inclusion of a second part to provide a substantial portion, at least a third, or a majority of a volume of the club head allows the L-cup part to be made thin and to include a high-grade material (e.g., a stamped sheet, a forging, or others). This higher grade material allows the design of the thickness in the sole return just aft of the face to decrease and thus increase ball speed. This thin region also transfers the maximum load region of the club head from the outward portion of the face to the sole return just aft of the face. Since stresses are transferred away from the face, the face does not have stress raisers associated with prior art club heads. According, a club head of the present invention ensures a more durable face.

Figure 18:
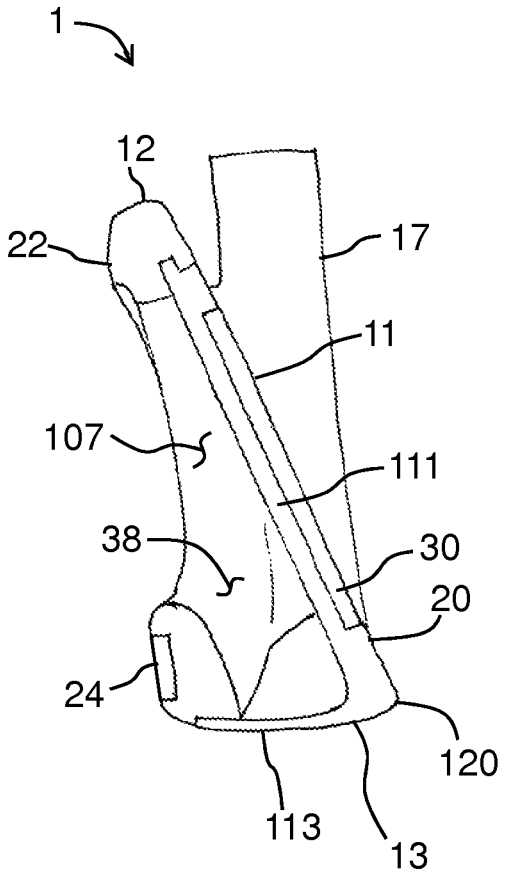
FIG. 18 is a cutaway view through a club head of certain embodiments.

FIG. 18 is a cutaway view through a club head 1 that includes a first body part 20 and a second body part 22. Optionally, a third body part 24 may be included. First body part 20 provides hosel 17 and at least a part of a sole portion 13 of club head 1. First body part 20 includes a face member 111 to provide at least a portion of a ball-striking face 11. Face member 111 extends around a face-sole transition 120 and into sole member 113. Sole member 113 provides at least a part of a downward-facing surface of sole 13. First body part 20 optionally supports a face insert 30.

Second body part 22 may include at least a part of sole 13, topline 12, and either or both of a heel portion and a toe portion of club head 1. Second body part 22 is preferably made of a low-density material such as a viscoelastic polymer. To provide an optimum MOI, CG, coefficient of restitution of face 11, or a combination thereof, second body part 22 can be formed to minimize mass high or in a central area of club head 1. For example, using a low-density second body part 22 in a cavity back club head can optimize MOI, CG, coefficient of restitution of face 11.

As shown in FIG. 18, second body part 22 cooperates with first body part 20 to define a cavity 107 in the back of club head 1. In addition, a recess 38 extends from cavity 107 towards sole 13. Sole 13 includes third body part 24, here in the form of a high density member mounted on second body part 22. To maximize playability, recess 38 extends all the way down such that a "floor" of the recess (e.g., a lower-most and upward-facing surface within recess 38 when club head 1 is at address) is provided by first body part 20. Although, as shown in FIG. 19 for example, recess 38 is not necessary.

The third body part 24 may be a single piece, or it may be provided as a plurality of separate pieces that are attached preferably to sole 13 (i.e., to one or both of first body part 20 and second body part 22). The third body part 24 is preferably formed high density material (i.e., density greater than that first body part 20 and second body part 22). Exemplary high-density materials include tungsten or tungsten alloys, including castable tungsten alloys. The density of the third body part 24 is preferably greater than 7.5 g/cc, and more preferably is 10 g/cc or greater. The third body part 24 can be provided in a variety of forms, such as in the form of a bar or one or more weight inserts, weight screws, slugs, or chips, lead tape, a leaded or other metallic powder coating, and may be permanently fixed to club head 1 or may be removable and interchangeable by a golfer. The third body part 24 can be formed in a variety of manners, including by powdered metallurgy, casting, and forging. An exemplary mass range for the third body part 24 is 2-30 grams.

Figure 19:
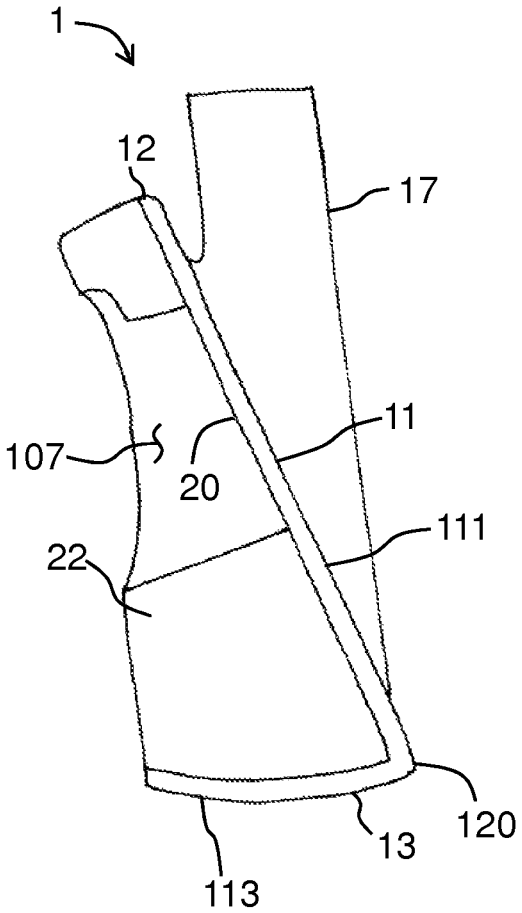
FIG. 19 shows a club head in which first body part includes a face member extending around a face-sole transition and into a sole member.

FIG. 19 shows a club head 1 in which first body part 20 includes face member 111 extending around a face-sole transition 120 and into sole member 113. Further, face member 111 provides hosel 17. A low-density body part 22 is mounted on a back surface of first body part 20 and includes a cavity 107. Low density body part 22 may meet first body part 20 along topline 12, as depicted in this embodiment. A high-density body portion 24 may be coupled to first body part 20 or second body part 22 (not pictured in FIG. 19 but could have a form as shown, for example, in any of FIGS. 3, 4, 7, 18, 21, 22, 23, and 28). As shown in FIG. 19, sole member 113 of first body part 20 extends aft from face member 111 and provides an entire lower-most surface of sole 13. It may be found that this construction, suggesting a backwards "L" as shown in FIG. 19, with face-sole transition 120 between sole member 113 and face member 111 provides an optimum coefficient of restitution while using a minimal amount of material for first body part 20, thereby freeing up a maximal amount of discretionary mass to be added back to club head 1 via one or more high density body part 24. An important feature of the bend from face member 111, around a leading edge of the sole and into sole 13 may provide first body part 20 with a "hot" face, even where first body part 20 does not also provide an entirety of a heel portion, a toe portion, or a topline of the club head.

Figure 20:
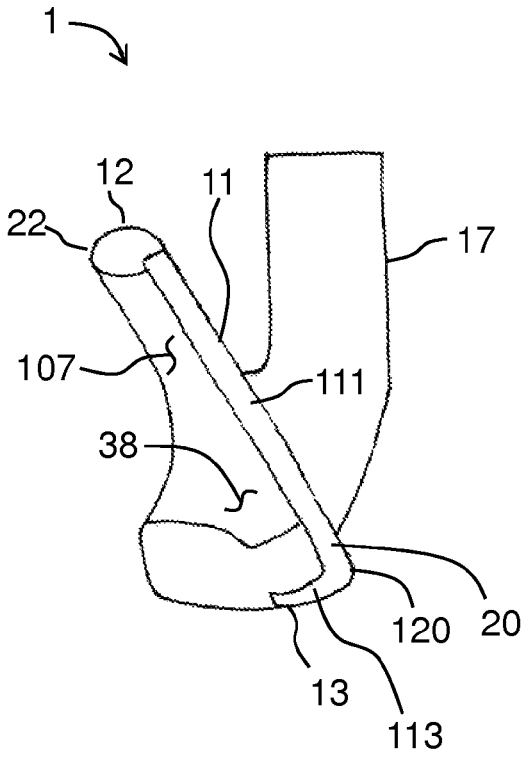
FIG. 20 depicts a variant construction in which a first body part includes a face member extending around a face-sole transition and into a sole member.

FIG. 20 depicts a variant construction in which first body part 20 includes face member 111 extending around a face-sole transition 120 and into sole member 113. Further, face member 111 provides hosel 17. A low-density body part 22 is mounted on a back surface of first body part 20 and includes a cavity 107. Club head 1 may include one or any number of high density body part 24. Here, a void space of cavity 107 continues towards sole 13 in a shallow recess 38. Face member 111 may optionally include a face insert 30 mounted in a peripheral opening as described elsewhere herein.

Figure 21:
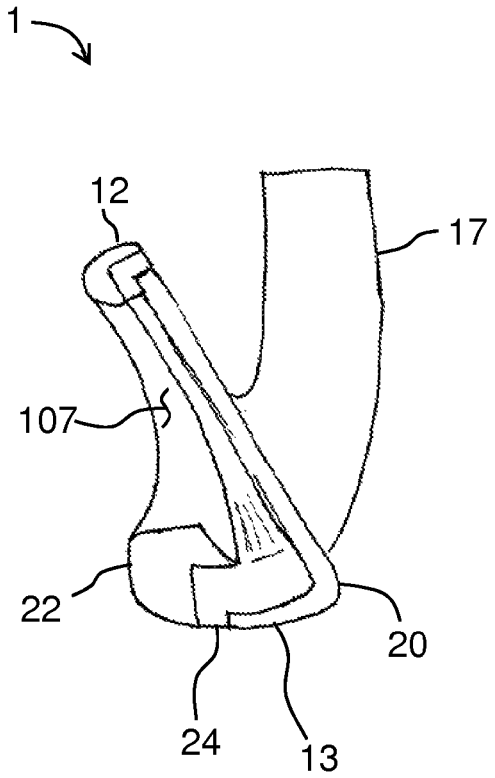
FIG. 21 shows an embodiment in which first body part is connected to a second body part through a third body part.

FIG. 21 shows an embodiment in which first body part 20 is connected to a second body part 22 through a third body part 24. This construction may provide for a high MOI club head 1. As can be seen in FIG. 21, second body part 22 is everywhere spaced away from first body part 20 by the presence of third body part 24. In the depicted embodiment, either of second body part 22 and third body part 24 may be a lower-density viscoelastic body part, with the other of second body part 22 and third body part 24 being a high-density body part. First body part includes face member 111 extending around a face-sole transition 120 and into sole member 113. Further, face member 111 provides hosel 17. A void space of cavity 107 continues towards sole 13 in a shallow recess 38. Face member 111 may optionally include a face insert 30 mounted in a peripheral opening as described elsewhere herein.

It may be found that including a second body part 22 that is everywhere spaced away from first body part 20 by the presence of third body part 24 provides additional damping benefits. Some golfers find certain golf clubs difficult to use due to vibrational shocks that are transmitted from the ball-striking face and into the golfer's arms during play. The constructions depicted herein that include a viscoelastic dampening member such as second body part 22 may minimize those shocks while increasing ball speed through the inclusion of face-sole transition 120 connecting face member 111 to sole member 113. Additional materials may also optionally be included for vibration dampening or mass distribution optimization.

Figure 22:
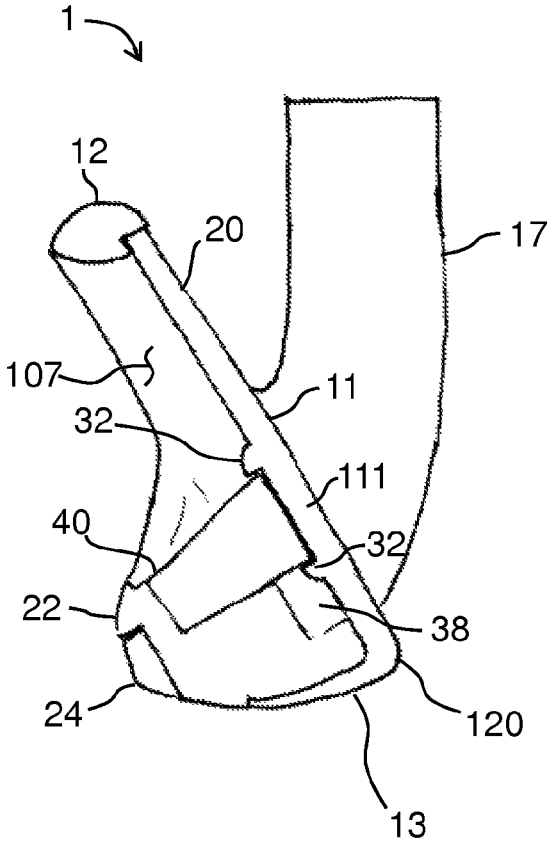
FIG. 22 shows a club head in which first body part includes a face member extending around a face-sole transition and into a sole member.

FIG. 22 shows a club head 1 in which first body part 20 includes face member 111 extending around a face-sole transition 120 and into sole member 113. Further, face member 111 provides hosel 17. Low-density body part 22 is mounted on a back surface of first body part 20 and includes a cavity 107. Low density body part 22 meets first body part 20 near topline 12, as depicted in this embodiment. A high-density body portion 24 is shown coupled to sole 13 through second body part 22.

On club head 1 as depicted in FIG. 22, an upper portion 111 of first body part 20 has, on a back surface thereof, one or more raised areas 32. (See also FIG. 7) These raised areas 32 are in at least partial contact with a damping member 40 when the club head 1 is assembled, and act as guide walls to help orient the damping member 40 into the desired proper position. The damping member 40 may be molded with first body part 20 and second body part 22. Alternatively, the damping member is positioned in the desired location within club head 1 during assembly. Preferably, the damping member 40 is larger than the resulting volume of its location in the assembled club head 1. Thus, when first body part 20 and second body part 22 are coupled, the damping member 40 is compressed, and is retained in a state of compression in the assembled club head 1 to further enhance vibration dissipation. Here, a recess 38 is at least capped or partially enclosed by damping member 40, leaving recess 38 as a void space within club head 1. This may optimize a coefficient of restitution of face 11. Alternatively, if greater damping is desired, damping member 40 may be included to fill recess 38 entirely.

Figure 23:
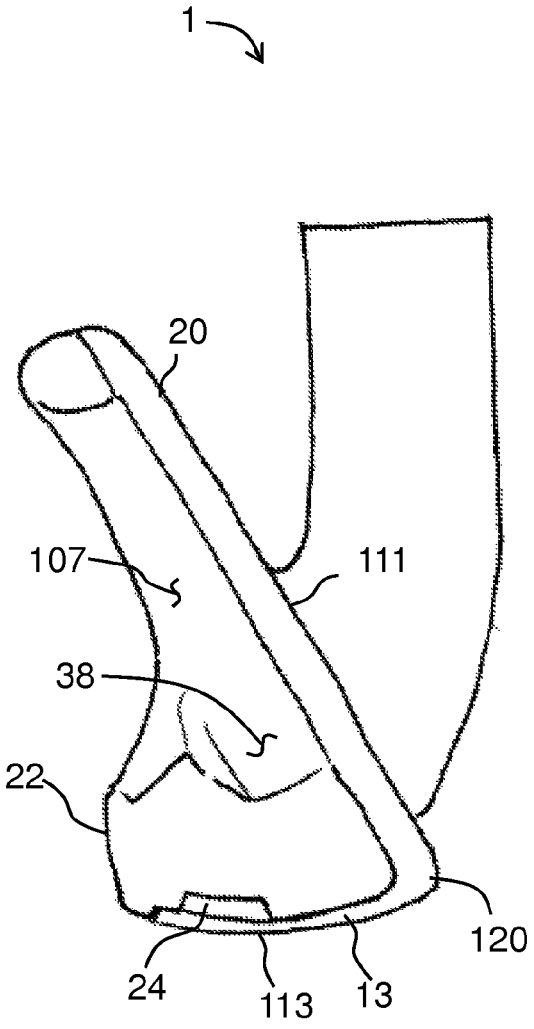
FIG. 23 illustrates a club head according to some embodiments.

FIG. 23 illustrates an alternative embodiment in which a high-density body part 24 is hidden from outside view. FIG. 23 shows club head 1 in which first body part 20 includes face member 111 extending around a face-sole transition 120 and into sole member 113. Further, face member 111 provides hosel 17. Low-density body part 22 is mounted on a back surface of first body part 20 and includes a cavity 107 as well as a shallow recess 38. Low density body part 22 meets first body part 20 substantially along topline 12, although those parts could meet proximal to topline 12 or, in an alternative, low density body part 22 could extend only partway up a back surface of first body part 20. A high-density body portion 24 is shown coupled to sole 13 at an interior location within the materials of club head 1. This allows club head 1 to benefit from the mass distribution optimization offered by high density body part 24 but, since high density body part 24 is contained within the materials, club head 1 may be made more durable as that body part will not be knocked off during play.

As shown herein, club head 1 generally includes at least a first body part 20 and a second part 22. A club head of the invention provides good playability by including in first body part 20 a face member 111 extending around a face-sole transition 120 and into sole member 113. Second body part 22 provides a remainder of an overall shape and volume of the club head, so that the club head plays like a golf club should and comports with rules of golf.

Figure 24:
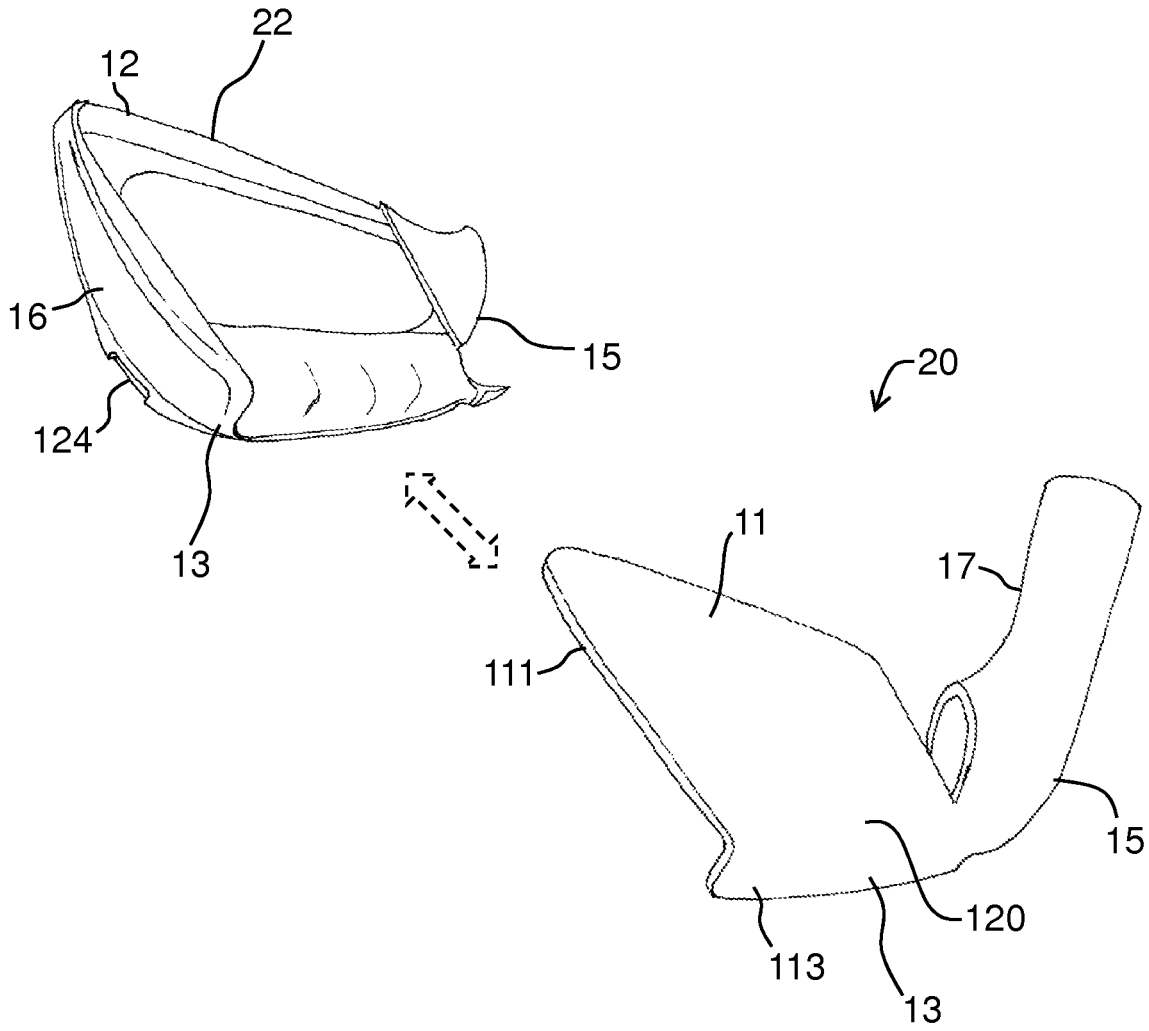
FIG. 24 shows a first body part and a second body part for a club head.

FIG. 24 shows a first body part 20 and a second body part 22 that may be assembled to provide a club head 1. Once assembled, sole 13 will include part of first body part 20 and second body part 22. Additionally, heel 15 will include part of first body part 20 and second body part 22. Second body part 22 meets first body part 20 along topline 12. As shown in FIG. 24, second body part 22 includes a recessed void 124 dimensioned to receive a third density body part 24 (not pictured in 24). While the picture shown in FIG. 24 depicts a first body part 20 and a second body part 22 of certain embodiments, the picture will also aid one of skill in the art to appreciate a relationship of body parts of numerous of the embodiments herein. FIG. 24 also aids in understanding an assembly of club head 1. Club head 1 as shown in any figure herein may be assembled in a variety of manners. One suitable assembly method includes first forming the first and third body parts 20, 24, such as by casting or forging. These parts 20, 24 may then be placed in a mold, and then the material forming the second body part 22 inserted into the mold. Thus, the second body part 22 is molded onto and/or around the first and third body parts 20, 24, creating a final shape of club head 1. The second body part 22 may thus be bonded to either or both of the first and third body parts 20, 24. This is referred to as a co-molding process. In an alternative embodiment, first body part 20, second body part 22, and optionally third body part 24 are formed separately and then assembled (e.g., as shown in FIG. 24). Body parts may be assembled by any suitable method including, for example, adhesive, welding, snap-fit, screws or other mechanical fasteners, or a combination thereof. These assembly methods may be applied to any club head 1 of embodiments shown and discussed herein.

The use of face member 111 extending around a face-sole transition 120 and into sole member 113 may be found to allow sole member 113 to be made thinner than in prior art club heads that included a seam between a sole area and a ball-striking face. Some prior art club heads include, somewhere between a ball striking face and a sole surface, an assembly joint between materials such as a weld or a mechanical meeting of materials. One insight of the invention is that those constructions include a fatigue or failure point proximal to an area of maximal stress and may have required an unduly thick sole for durability. Accordingly, the invention includes the insight that using a body part that extends continuously from a face to a sole (and that may include a face insert or may provide a ball striking face) allows that body part to be shaped to re-distribute stresses and move an area of maximal stress away from features of the face of the club head.

Figure 25:
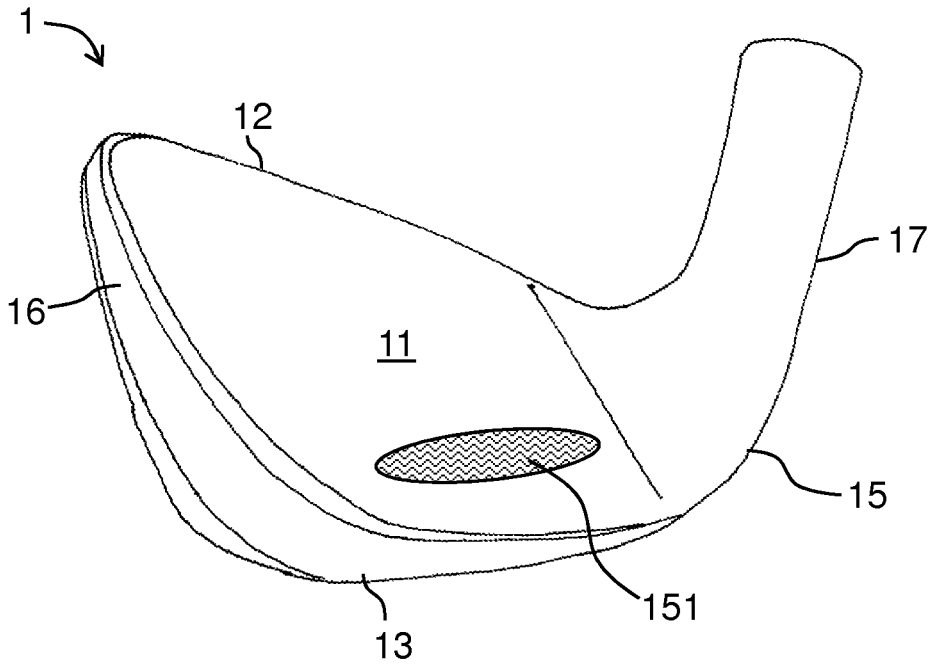
FIGS. 25 & 26 illustrate locations of maximum stress.

FIG. 25 shows a golf club head 1 with a front surface 11, a top line 12, a sole 13, a heel 15, a toe 16, and a hosel 17. The depicted design has a thick sole 13, which causes a region of maximum stress 151 to occur on the outward portion of the face. Golf club heads typically may include stress raisers such as welds, score lines, material discontinuities from fabrication, or other blemishes in a face area. Where stress raisers are co-located with region of maximum stress 151 this can lead to breakage or material fatigue or failure.

Figure 26:
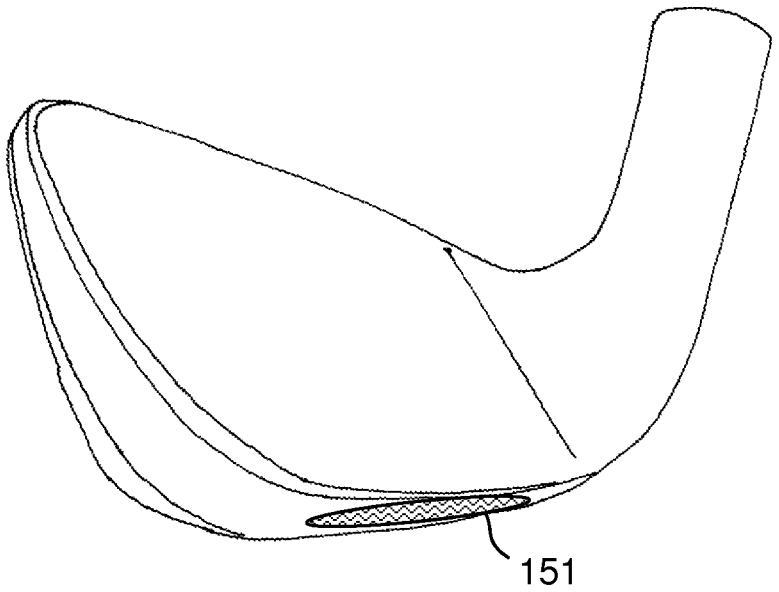

FIG. 26 shows a club head in which a sole member 113 extending back from face member 111 is made thin. Because this design has a thin sole return portion just aft of the face it can be seen that the maximum stress region 151 occurs on the sole portion of the club head. This relieves much of the stress on the outward portion of the face which contains stress raisers. Thus one feature of a club head of the invention is a face comprising a material that extends into a sole return through a face-to-sole transition area. While this construction may be embodied in any type of club head, it may have particular benefit in an iron-type club head or a wedge-type club head. In certain embodiments, a club head of the invention that includes a body part 20 with a face member 111 extending into a sole member 113 through a face-sole transition 120 is an iron type club head such as, for example, a cavity back iron, a muscle back iron, or a hybrid thereof.

Figure 27:
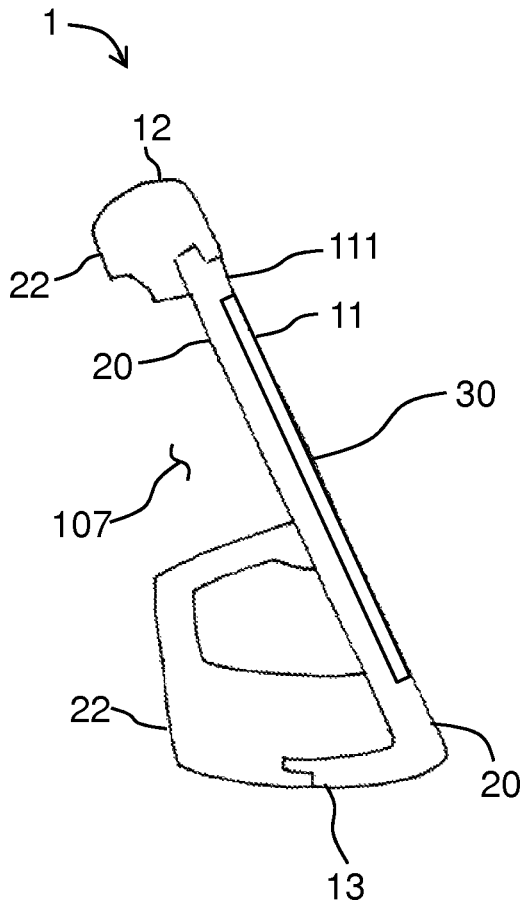
FIG. 27 is a cross-sectional view through a cavity-back iron-style club head.

FIG. 27 is a cross-sectional view through a cavity-back iron-style club head 1 of certain embodiments. As shown in FIG. 27, first body part 20 extends to provide a portion of the front surface 11 and a portion of sole 13, including a portion of a lowermost surface of sole 13. Second body part 22 extends from topline 12 down through the heel and toe ends of club head 1 and across a back portion of sole 13, thereby defining cavity 107. Sole 13 is provided by first body part 20 and second body part 22. There is an enclosed void space within the bulk of the body of club head 1 formed by second body part 22 wrapping around to meet a back surface of first body part 20. This may be included to further lower a CG and free up more discretionary mass without interfering with club head aerodynamics (relative to, e.g., club head 1 as shown in FIG. 19). Face member 111 includes a face insert 30.

Figure 28:
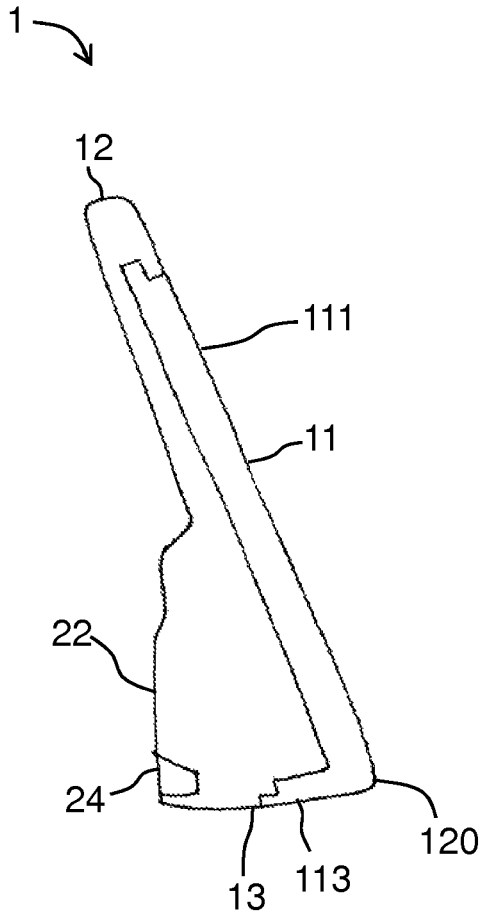
FIG. 28 is a cross-sectional view through a muscle-back iron-style club head.

FIG. 28 is a cross-sectional view through a muscle-back iron-style club head 1 according to certain embodiments. Here, first body part 20 includes face member 111 extending into sole member 113 through face-sole transition 120. As in other embodiments shown herein, face-sole transition 120 defines a bent shape (although it need not be formed by bending a previously flat piece of material where, for example, first body part 20 is cast or sintered). Face sole transition 120 may be described as a bent shape in that face member 111 and sole member 113 extend away from the transition area in directions that define an angle (i.e., related to the loft angle of the club head). As shown in FIG. 28, second body part 22 is mounted on a back surface of first body part 20 and provides an entire topline 12 of club head 1. First body part 20 and second body part 22 have external surfaces that meet along a seam near a top of face 11. First body part 20 and second body part 22 cooperate to provide sole 13. A third body part 24 is mounted to sole 13. In some embodiments, first body part 20 is made of a metallic material, second body part 22 is made of a viscoelastic polymer, third body part 24 is made with a high-density material, or a combination thereof.

FIGS. 18-24, 27, and 28 all show embodiments in which a front component 20 formed of a first material includes a face member 111, a face-sole transition bend 120 at a lower portion of face member 111, a sole return 113 extending back from the face-sole transition bend 120. Front component 20 preferably includes hosel 17 extending therefrom. In some embodiments, a front surface of the front component 20 provides at least a portion of a ball-striking face 11 (i.e., there may or may not be an insert 30 and where there is an insert 30, the surrounding area of the front surface provides an outer portion of the ball-striking face 11). As show in FIGS. 18-24, 27, and 28 a back component 22 is formed of a second material distinct from the first material and attached to a back surface of the face member 111 and cooperating with the front component 20 to define at least a substantial portion of a volume of club head 1. Preferably, back component 22 provides at least a quarter of a volume of club head 1, and club head one further includes a high-density member (e.g., density at least 7 g/cc) that provides a substantial portion of the volume. Substantial portion may be taken to mean at least about ten percent. Volume of an object may be taken to refer to a volume of water that the object would displace if submerged in water.

As used herein, directional references such as rear, front, lower, etc. are made with respect to the club head when grounded at the address position. See, for example, FIGS. 1 and 2. The direction references are included to facilitate comprehension of the inventive concepts disclosed herein, and should not be read as limiting.

While the inventive concepts have been discussed predominantly with respect to iron-type golf club heads, such concepts may also be applied to other club heads, such as wood-types, hybrid-types, and putter-types.

As used herein, the word "or" means "and or or", sometimes seen or referred to as "and/or", unless indicated otherwise.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the high-density body part is provided as a plurality of separate pieces that are attached to the sole portion.

2. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the high-density body part has a density of at least 7.5 g/cc.

3. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the high-density body part comprises tungsten.

4. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the high-density body part is in the form of a bar.

5. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the high-density body part is coupled to both the first and the low-density body parts.

6. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the low-density body part provides at least a third of a volume of the club head.

7. A golf club head comprising:

a first body part providing a hosel and at least a part of a sole portion of the club head, the first body part comprising a front surface bent around a face-sole transition and providing at least a portion of a ball-striking face and at least a part of a downward-facing surface of the sole portion;

a low-density body part coupled to a rear surface of the first body part and providing at least a part of the sole portion, a heel portion, and a toe portion of the club head; and a high-density body part coupled to the sole portion, wherein the low-density body part provides a majority of a volume of the club head.

8. A golf club head comprising:

a first body part comprising: a sole member providing at least a part of a downward-facing surface of a sole portion of the club head, a face member providing at least a part of a ball-striking face and extending down around a face-sole transition and into the sole member, and a hosel extending upwards from a heel-side portion of the face member; and a second body part coupled to a back surface of the first body part and providing at least part of the sole portion of the club head, wherein the second part contributes at least a third of a volume of the club head.

9. A golf club head comprising:

a front component formed of a first material and comprising a face member, a face-sole transition bend at a lower portion of the face member, a sole return extending back from the face-sole transition bend, and a hosel extending from the front component, wherein a front surface of the front component provides at least a portion of a ball-striking face; and a back component formed of a second material distinct from the first material and attached to a back surface of the face member and cooperating with the front component to provide a main body of the club head, wherein the back component provides at least a quarter of a volume of the club head.

10. A golf club head comprising:

a front component formed of a first material and comprising a face member, a face-sole transition bend at a lower portion of the face member, a sole return extending back from the face-sole transition bend, and a hosel extending from the front component, wherein a front surface of the front component provides at least a portion of a ball-striking face; and a back component formed of a second material distinct from the first material and attached to a back surface of the face member and cooperating with the front component to provide a main body of the club head, further comprising a high-density component disposed on the main body of the club head.

11. The club head of claim 10, further wherein the back component is also attached to an upper surface of the sole return.

12. The club head of claim 11, wherein the sole return and back component cooperate to provide a downward facing surface of a sole of the club head, wherein the downward facing surface faces downward when the club head is at address.

* * * * *